US012467223B2

(12) United States Patent
Yoshimura et al.

(10) Patent No.: US 12,467,223 B2
(45) Date of Patent: Nov. 11, 2025

(54) WORK VEHICLE APPARATUS FOR LOADING EFFICIENCY

(71) Applicant: Hitachi Construction Machinery Co., Ltd., Tokyo (JP)

(72) Inventors: Masatoshi Yoshimura, Tokyo (JP); Hiroyuki Kobayashi, Tokyo (JP); Satoru Kaneko, Tokyo (JP); Noritaka Itou, Ibaraki (JP); Satoshi Sekino, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 208 days.

(21) Appl. No.: 18/021,202

(22) PCT Filed: Feb. 18, 2022

(86) PCT No.: PCT/JP2022/006765
§ 371 (c)(1),
(2) Date: Feb. 14, 2023

(87) PCT Pub. No.: WO2022/202027
PCT Pub. Date: Sep. 29, 2022

(65) Prior Publication Data

US 2023/0313488 A1 Oct. 5, 2023

(30) Foreign Application Priority Data

Mar. 24, 2021 (JP) ..... 2021-049604

(51) Int. Cl.
*E02F 3/43* (2006.01)
*E02F 9/20* (2006.01)
*E02F 9/22* (2006.01)

(52) U.S. Cl.
CPC ..... *E02F 3/434* (2013.01); *E02F 9/2075* (2013.01); *E02F 9/2079* (2013.01); *E02F 9/2235* (2013.01)

(58) Field of Classification Search
CPC ..... E02F 3/434; E02F 9/2075; E02F 9/2079; E02F 9/2235; E02F 9/2029; E02F 9/2045; E02F 9/2095; E02F 9/262; Y02T 10/62
(Continued)

(56) References Cited

U.S. PATENT DOCUMENTS

2016/0002883 A1 1/2016 Sakon
2018/0305900 A1* 10/2018 Letscher ..... E02F 3/431
(Continued)

FOREIGN PATENT DOCUMENTS

CN 103592949 A * 2/2014
EP 3 412 936 A1 12/2018
(Continued)

OTHER PUBLICATIONS

International Search Report (PCT/ISA/210) issued in PCT Application No. PCT/JP2022/006765 dated Apr. 5, 2022 with English translation (four (4) pages).
(Continued)

*Primary Examiner* — Tiffany P Young
*Assistant Examiner* — Shien Ming Chou
(74) *Attorney, Agent, or Firm* — Crowell & Moring LLP

(57) ABSTRACT

The work vehicle 1 includes a main controller 100 that controls a travel driving force and a work driving force. The main controller 100 includes a travel remaining time calculating unit 111 that calculates a remaining time until a target rise/run distance is reached as a travel remaining time $t_C$, a work remaining time calculating unit 112 that calculates a remaining time until a target arm angle is reached as a work remaining time $t_1$, a rise/run determining unit 113 that
(Continued)

determines whether rise/run is being performed or not, a correction rate setting unit 114 that sets a travel correction rate $\eta_C$ that adjusts a travel driving torque and a work correction rate $\eta_I$ that adjusts a work driving torque based on the travel remaining time $t_C$, the work remaining time $t_1$, and the rise/run determination flag, and an engine torque distribution calculating unit 115 that calculates a travel driving torque command and a work driving torque command based on the travel correction rate $\eta_C$ and the work correction rate $\eta_I$.

4 Claims, 13 Drawing Sheets

(58) Field of Classification Search
USPC ..... 701/50
See application file for complete search history.

(56) References Cited

U.S. PATENT DOCUMENTS

| | | | | |
|---|---|---|---|---|
| 2019/0161940 | A1 | 5/2019 | Takeda et al. | |
| 2020/0018037 | A1 | 1/2020 | Nakamura et al. | |
| 2020/0199852 | A1 * | 6/2020 | Hyodo | E02F 9/2253 |
| 2020/0248436 | A1 | 8/2020 | Hyodo et al. | |
| 2020/0378089 | A1 | 12/2020 | Hyodo et al. | |

FOREIGN PATENT DOCUMENTS

| | | | | |
|---|---|---|---|---|
| JP | 2018-53539 | A | 4/2018 | |
| JP | 2019-65576 | A | 4/2019 | |
| WO | WO 2015/083753 | A1 | 6/2015 | |
| WO | WO-2018008189 | A1 * | 1/2018 | E02F 3/43 |
| WO | WO 2019/065122 | A1 | 4/2019 | |
| WO | WO 2020/065913 | A1 | 4/2020 | |

OTHER PUBLICATIONS

Japanese-language Written Opinion (PCT/ISA/237) issued in PCT Application No. PCT/JP2022/006765 dated Apr. 5, 2022 (three (3) pages).

Korean-language Notice of Allowance issued in Korean Application No. 10-2023-7006034 dated May 8, 2025 (5 pages).

* cited by examiner

WORK VEHICLE APPARATUS FOR LOADING EFFICIENCY

TECHNICAL FIELD

The present invention relates to a work vehicle, such as a wheel loader, used for loading work.

The present application claims priority from Japanese patent application JP 2021-049604 filed on Mar. 24, 2021, the entire content of which is hereby incorporated by reference into this application.

BACKGROUND ART

As a work vehicle, there has been known a wheel loader including, for example, a traveling device for moving a vehicle body and a working device including a bucket and an arm for excavating, for example, earth and sand. When such a work vehicle excavates and loads the earth and sand or the like in the bucket onto a loading target, such as a dump truck, the work vehicle performs an operation called rise/run, which lifts the arm as moving the vehicle body forward to the loading target. An operation associated with this rise/run requires operations of an arm operating lever, an accelerator pedal, and a brake pedal and requires complicated operations, therefore heavily burdening an operator. In addition, operating to move the vehicle body forward fast to right in front of the loading target and completely lifting the arm to the necessary height right before the loading target improves both carrying work efficiency and fuel efficiency, and thus, the operator is forced to perform precise operations according to the situation.

For example, Patent Literature 1 discloses a work vehicle that controls a transmission torque transmitted from a power generation device to driving wheels such that a difference between a first ratio that is a ratio of a value corresponding to a target traveling distance traveled by a vehicle body to a position where the vehicle body discharges an excavated object after the excavation by a bucket to a value corresponding to a target lifting amount by which an arm is lifted after the start of the forward movement and a second ratio that is a ratio of a value corresponding to a distance that has actually been traveled by the vehicle body after the start of the forward movement to a value corresponding to the amount by which the arm has been actually lifted after the start of the forward movement is zero.

CITATION LIST

Patent Literature

Patent Literature 1: WO 2015/083753

SUMMARY OF INVENTION

Technical Problem

The work vehicle described in Patent Literature 1 results in controlling travel driving force so as to maintain the ratio of the target traveling distance to the target lifting amount in the case where the operation associated with rise/run is performed. In view of this, since the traveling device is not controlled when the height of the bucket at the start of the rise/run operation is high and/or when a road surface to the loading target is acclivitous, the target lifting amount is reached before the target traveling distance is reached, and therefore, reductions in carrying work efficiency and fuel efficiency may be caused. In order to avoid the reductions in carrying work efficiency and fuel efficiency, an operator needs to perform complicated and precise operations of adjusting the operation amounts of the arm operating lever and the accelerator pedal during the rise/run operation and completely lifting the arm to the necessary height right before the loading target. Therefore, the burden on the operator is still heavy.

The present invention is made in view of solving such technical problems, and an objective of the present invention is to provide a work vehicle that allows reducing operational burdens on an operator during loading work.

Solution to Problem

A work vehicle according to the present invention comprising: a traveling device that causes a vehicle body to travel; a travel prime mover that supplies a travel driving force to the traveling device; a working device disposed on the vehicle body, the working device including an arm turnable in a vertical direction; a work prime mover that supplies a work driving force to the working device; a traveling state detecting device that detects a traveling state of the vehicle body including a vehicle speed and a traveling distance; a working state detecting device that detects a working state of the working device including an angle of the arm; and a control device that controls the travel prime mover and the work prime mover, wherein the control device: determines whether a specific condition that identifies lifting of the arm during forward traveling of the vehicle body during a loading work is satisfied or not, based on the traveling state of the vehicle body detected by the traveling state detecting device and the working state of the working device detected by the working state detecting device; sets a travel correction rate for adjusting the travel driving force and a work correction rate for adjusting the work driving force, based on the vehicle speed and the traveling distance detected by the traveling state detecting device, the angle of the arm detected by the working state detecting device, and a target traveling distance set in advance, and a target arm angle set in advance, when the specific condition is determined to be satisfied; and controls the travel driving force of the travel prime mover and the work driving force of the work prime mover based on the set travel correction rate and work correction rate.

In the work vehicle according to the present invention, the control device sets the travel correction rate and the work correction rate based on the vehicle speed and the traveling distance detected by the traveling state detecting device, the angle of the arm detected by the working state detecting device, and a target traveling distance set in advance, and a target arm angle set in advance, and controls the travel driving force of the travel prime mover and the work driving force of the work prime mover based on the set travel correction rate and work correction rate. This allows to align a time at which the forward traveling is completed and a time at which the arm lifting is completed while adjusting a balance between the travel driving force and the work driving force, thereby allowing a reduced burden on an operator. This also allows shortening the time for the loading work, thereby allowing improved operation efficiency of the loading work and improved fuel efficiency.

Advantageous Effects of Invention

The present invention allows reducing operational burdens on an operator during loading work.

DESCRIPTION OF EMBODIMENTS

Figure 1:
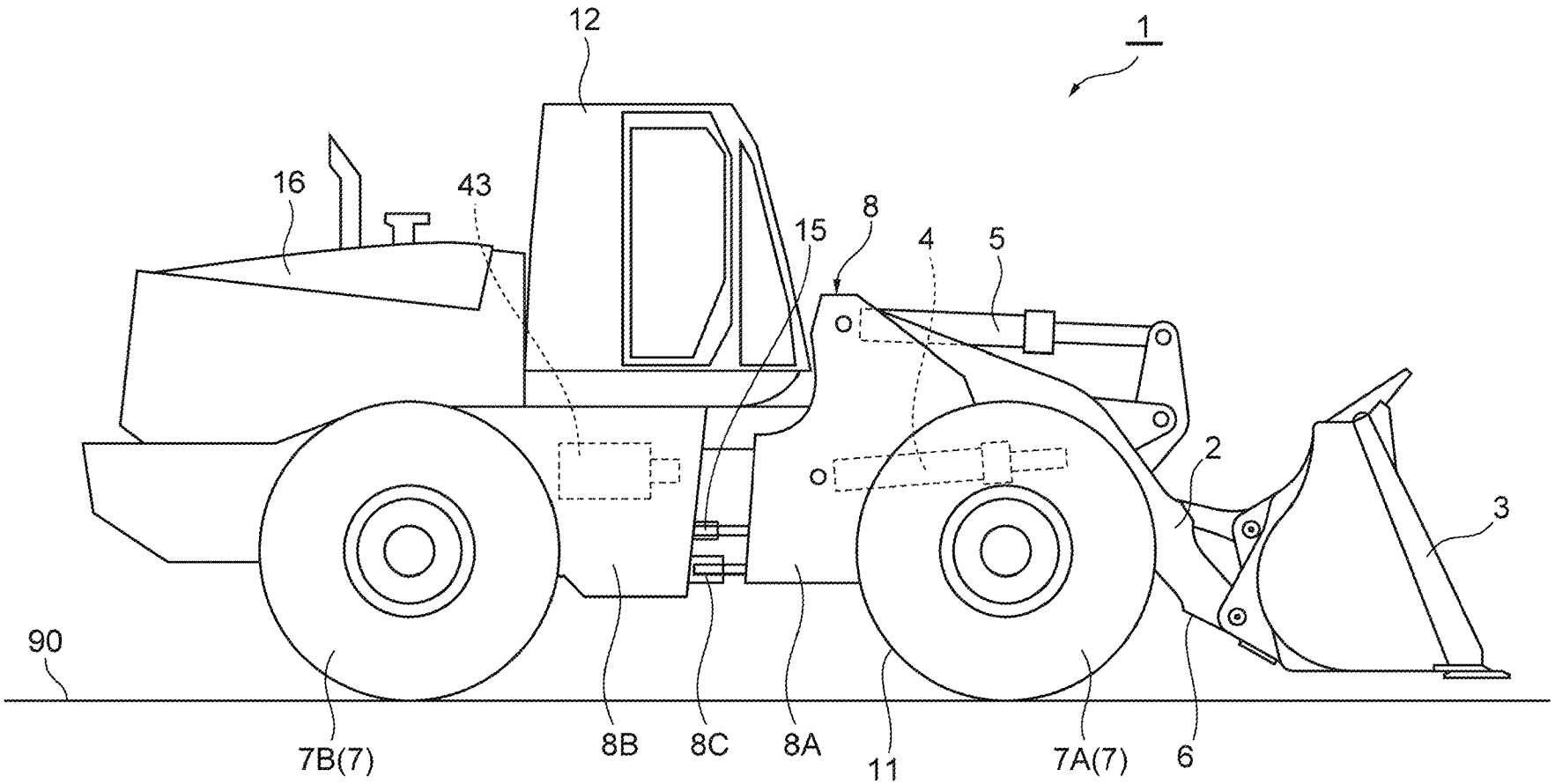
FIG. 1 is a side view illustrating a work vehicle according to a first embodiment.

The following describes embodiments of a work vehicle according to the present invention with reference to the drawings. In descriptions of the drawings, same reference numerals are given to the same elements, and therefore repeated explanations will be omitted. While the following description is made with the example in which the work vehicle is a wheel loader, the work vehicle of the present invention is not limited to the wheel loader and may be a fork-lift truck, a lift truck, a telehandler, or the like. While the following description is made with the example in which a hybrid system that uses an engine and a generator motor as a driving source is employed, a system that uses only an engine may be employed. Furthermore, in the following description, directions and positions of up and down, right and left, and front and rear are based on an ordinarily used state of the work vehicle, that is, a state where the wheels are in contact with the ground.

First Embodiment

FIG. 1 is a side view illustrating a work vehicle according to a first embodiment. As illustrated in FIG. 1, a work vehicle 1 of the embodiment is, for example, an electric-drive type wheel loader and includes a vehicle body 8 including an electrically operated type traveling device 11 and an articulated working device 6 disposed in a front portion of the vehicle body 8. The vehicle body 8 is of an articulated steering system (a vehicle body bending type) and includes a front vehicle body 8A, a rear vehicle body 8B, and a center joint 8C that couples the front vehicle body 8A to the rear vehicle body 8B. The above-described working device 6 is mounted in the front vehicle body 8A and a driver's cabin 12 and an engine compartment 16 are arranged in the rear vehicle body 8B. In the driver's cabin 12, various kinds of operating members (51 to 58) for an operator to operate the work vehicle 1 are disposed and the engine compartment 16 houses an engine 20, hydraulic pressure pumps 30A, 30B, and 30C, and a hydraulic pressure device, such as a valve (see FIG. 2).

The working device 6 includes a pair of right and left arms (also referred to as lift arms) 2 mounted on the front vehicle body 8A turnably in a vertical direction and a bucket 3 coupled to a distal end portion of the arm 2 and mounted turnably in the vertical direction. In the embodiment, a Z-linkage (bell crank) link mechanism is employed as a link mechanism for operating the bucket 3.

Figure 2:
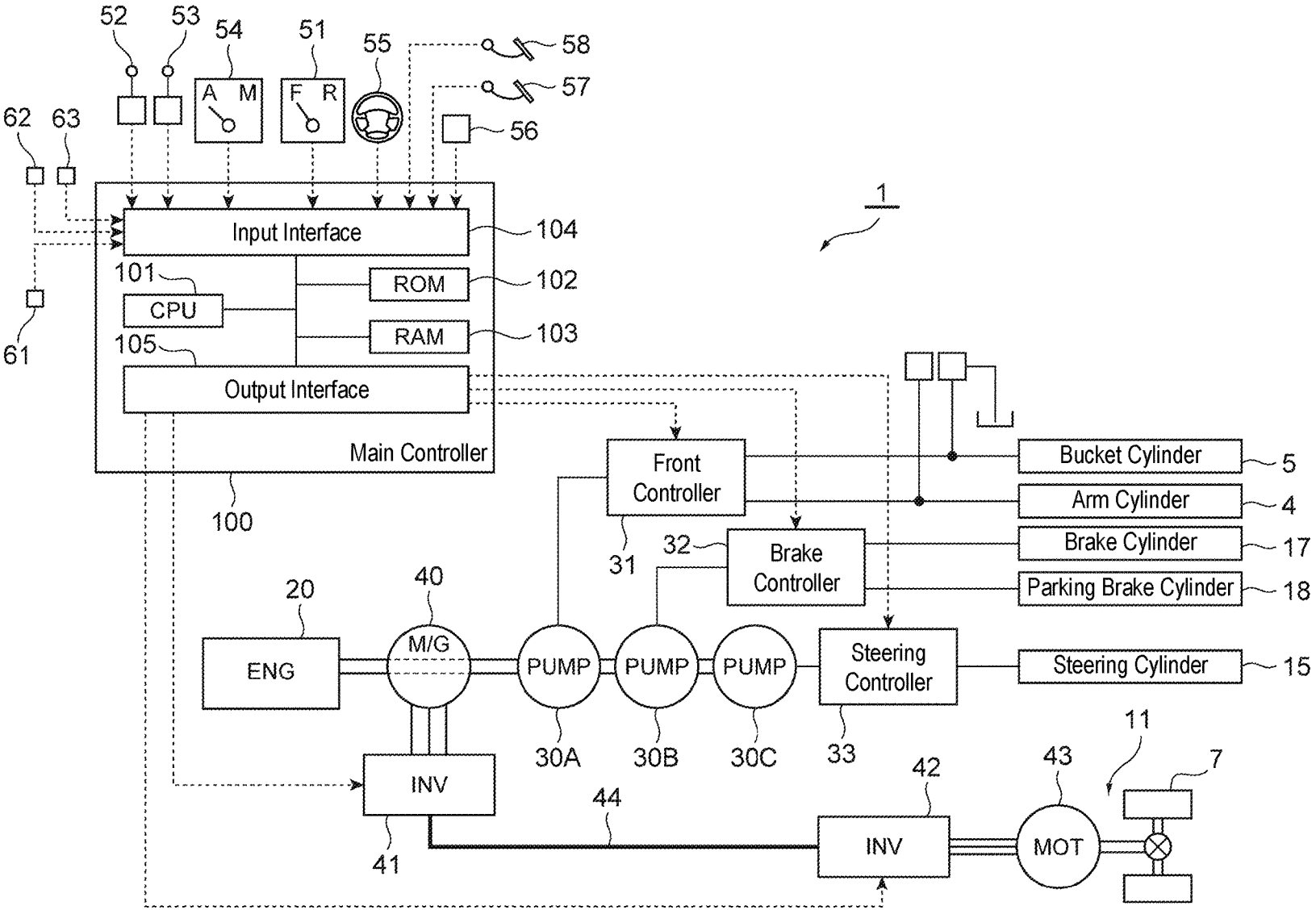
FIG. 2 is a system configuration diagram illustrating the work vehicle according to the first embodiment.

FIG. 2 is a system configuration diagram illustrating the work vehicle according to the first embodiment. As illustrated in FIG. 2, the work vehicle 1 includes the engine 20, a generator motor 40 mechanically connected to the engine 20, the hydraulic pressure pumps 30A, 30B, and 30C mechanically connected to the engine 20 and the generator motor 40, an arm cylinder 4 and a bucket cylinder 5 driven by a hydraulic oil discharged from the hydraulic pressure pump 30A, a front controller 31 that controls the hydraulic oil discharged from the hydraulic pressure pump 30A, a brake cylinder 17 and a parking brake cylinder 18 driven by a hydraulic oil discharged from the hydraulic pressure pump 30B, brake controller 32 that controls the hydraulic oil discharged from the hydraulic pressure pump 30B, a steering cylinder 15 driven by a hydraulic oil discharged from the hydraulic pressure pump 30C, a steering controller 33 that controls the hydraulic oil discharged from the hydraulic pressure pump 30C, and the above-described traveling device 11 driven by electric power generated by the generator motor 40.

The engine 20 is a primary prime mover and is constituted of an internal combustion engine, such as a diesel engine. The generator motor 40 is rotated by torque output from the engine 20.

The hydraulic pressure pumps 30A, 30B, and 30C are driven by a torque output from the engine 20 and discharge the hydraulic oil as a working fluid. Note that, when the generator motor 40 functions as an electric motor, the hydraulic pressure pumps 30A, 30B, and 30C are driven by a torque output by the engine 20 and the generator motor 40.

The hydraulic oil discharged from the hydraulic pressure pump 30A is supplied to the arm cylinder 4 and the bucket cylinder 5 via the front controller 31. The front controller 31 controls the telescopic motions of the arm cylinder 4 and the bucket cylinder 5 by controlling the pressure, speed, and flow direction of the hydraulic oil discharged from the hydraulic pressure pump 30A.

The arm cylinder 4 is constituted of a hydraulic cylinder and is expanded and contracted by the hydraulic oil supplied from the hydraulic pressure pump 30A, and this telescopic motion turns the arm 2 in a vertical direction. The arm cylinders 4 are in pair so as to correspond to the pair of right and left arms 2. The bucket cylinder 5 is constituted of a hydraulic cylinder and is expanded and contracted by the hydraulic oil supplied from the hydraulic pressure pump 30A, and this telescopic motion turns the bucket 3 in the vertical direction. In the embodiment, the hydraulic pressure pump 30A constitutes a work prime mover that supplies work driving force to the working device 6.

The hydraulic oil discharged from the hydraulic pressure pump 30B is supplied to the brake cylinder 17 and the parking brake cylinder 18 via the brake controller 32. The brake controller 32 controls the telescopic motions of the brake cylinder 17 and the parking brake cylinder 18 by controlling the pressure, speed, and flow direction of the hydraulic oil discharged from the hydraulic pressure pump 30B.

The hydraulic oil discharged from the hydraulic pressure pump 30C is supplied to the steering cylinder 15 via the steering controller 33. The steering controller 33 controls the telescopic motion of the steering cylinder 15 by controlling the pressure, speed, and flow direction of the hydraulic oil discharged from the hydraulic pressure pump 30C. The steering cylinders 15 are constituted of hydraulic cylinders, are in pair of right and left, and are disposed to couple the front vehicle body 8A to the rear vehicle body 8B.

The traveling device 11 includes front wheels 7A (wheels 7) mounted on the front vehicle body 8A, rear wheels 7B (wheels 7) mounted on the rear vehicle body 8B, and a power transmission device that transmits power from a traveling motor 43 to the wheels 7. The wheels 7 are rotated by the driving of the traveling motor 43 to move the work vehicle 1 forward and rearward. The power transmission device is constituted by including, for example, an axle, a differential unit, and a propeller shaft.

The traveling motor 43 is a constituent of a secondary prime mover and is rotated by receiving the electric power generated by the generator motor 40. In the embodiment, the generator motor 40 and the traveling motor 43 constitute a travel prime mover that supply travel driving force to the traveling device 11.

The work vehicle 1 further includes a main controller (a control device) 100 that controls the whole vehicle, an inverter 41 for generator motor that controls the generator motor 40 based on a generation voltage command from the main controller 100, an inverter 42 for traveling motor that controls the torque of the traveling motor 43 based on a travel driving torque command from the main controller 100, and various kinds of operating members (51 to 58) disposed in the driver's cabin 12.

The driver's cabin 12 is provided with a forward and rearward movement switch 51 that switches between the forward movement (F) and the rearward movement (R) of the vehicle body 8, an arm operating lever 52 for operating the arm 2, a bucket operating lever 53 for operating the bucket 3, a mode changeover switch (a mode changeover device) 54 that switches between the AUTO mode and the MANUAL mode, a steering wheel 55 for instructing right and left direction of travel of the vehicle body 8, a parking brake switch 56 for actuating the parking brake, an accelerator pedal 58 for accelerating the vehicle body 8, and a brake pedal 57 for decelerating the vehicle body 8.

As soon as the arm operating lever 52 is operated, the arm 2 is turned in the vertical direction (an elevating motion) by the telescopic motion of the arm cylinder 4. As soon as the bucket operating lever 53 is operated, the bucket 3 is turned in the vertical direction (a crowding motion or a dumping motion) by the telescopic motion of the bucket cylinder 5.

As soon as the steering wheel 55 is operated, the front vehicle body 8A bends (steers) to right and left centering the center joint 8C with respect to the rear vehicle body 8B in association with the telescopic motion of the steering cylinder 15.

When the accelerator pedal 58 is pressed with the forward and rearward movement switch 51 being operated in the forward movement (F) side, the wheels 7 are rotated in the direction of forward movement and the vehicle body 8 travels forward. On the other hand, when the accelerator pedal 58 is pressed with the forward and rearward movement switch 51 being operated in the rearward movement (R) side, the wheels 7 are rotated in the direction of rearward movement and the vehicle body 8 travels rearward.

The mode changeover switch 54 is a switch that allows manually switching between the AUTO mode and the MANUAL mode. The AUTO mode is an execution mode that executes setting of a travel correction rate and a work correction rate described later, in other words, is a mode in which a pressing amount of the accelerator pedal 58 and an operation amount of the arm operating lever 52 are controlled based on the vehicle speed and the arm angle (the angle of the arm 2) of the work vehicle 1. In contrast, the MANUAL mode is an inhibition mode that inhibits the execution of the setting of the travel correction rate and the work correction rate, in other words, is a mode in which the pressing amount of the accelerator pedal 58 or the operation amount of the arm operating lever 52 is not controlled based on the vehicle speed and the arm angle.

That is, this mode changeover switch 54 has an AUTO mode position and a MANUAL mode position. When the mode changeover switch 54 is operated to be in the AUTO mode position, the mode is set to the AUTO mode, and therefore, the signal representing that the mode is set to the AUTO mode is output to the main controller 100. When the mode changeover switch 54 is operated to be in the MANUAL mode position, the mode is set to the MANUAL mode, and therefore, the signal representing that the mode is set to the MANUAL mode is output to the main controller 100.

The main controller 100 is constituted of a microcomputer including a Central Processing Unit (CPU) 101 as an operation circuit, a Read Only Memory (ROM) 102 and a Random Access Memory (RAM) 103 as memories, an input interface 104, an output interface 105, and other peripheral circuits. Note that, the main controller 100 may be constituted of one microcomputer or may be constituted of a plurality of microcomputers.

The ROM 102 of the main controller 100 is a non-volatile memory, such as an EEPROM, in which a program that can execute various operations is stored. That is, the ROM 102 of the main controller 100 is a storage medium that can read a program that implements the function of the embodiment. The RAM 103 is a volatile memory and is a working memory that directly inputs and outputs data with the CPU 101. The RAM 103 temporarily stores necessary data while the CPU 101 executes and operates the program. Note that the main controller 100 may further include a memory, such as a flash memory and a hard disk drive.

The CPU 101 is a processing device that deploys the program, which is stored in the ROM 102, in the RAM 103 and executes and operates the program, and performs predetermined arithmetic processing on the signal taken in from the input interface 104 and the ROM 102, and the RAM 103 in accordance with the program.

Operation signals from various kinds of operating members and sensor signals from various kinds of sensors are input to the input interface 104. The input interface 104 converts the input signal such that it can be operated in the CPU 101. The output interface 105 generates a signal for outputting corresponding to the result of the operation in the CPU 101 and outputs the signal to, for example, the front controller 31, the brake controller 32, the steering controller 33, the inverter 41 for generator motor, and the inverter 42 for traveling motor.

The main controller 100 integrally controls the front controller 31, the brake controller 32, the steering controller 33, the inverter 41 for generator motor, and the inverter 42 for traveling motor based on the operation signal input by the operation of the operator and the sensor signals detected by the various kinds of sensors.

Examples of the operation signals input to the main controller 100 include, for example, an acceleration signal representing an operation amount of the accelerator pedal 58 output from the accelerator pedal 58, a brake signal representing an operation amount of the brake pedal 57 output from the brake pedal 57, an arm signal representing an operation amount of the arm operating lever 52 output from the arm operating lever 52, a bucket signal representing an operation amount of the bucket operating lever 53 output from the bucket operating lever 53, a steering signal representing an operation amount of the steering wheel 55 output from the steering wheel 55, and a traveling direction signal representing an operation position of the forward and rearward movement switch 51 output from the forward and rearward movement switch 51. Examples of the operation signals input to the main controller 100 also include a mode switching signal representing an operation position of the mode changeover switch 54 output from the mode changeover switch 54.

Furthermore, examples of the sensor signals input to the main controller 100 include a signal representing an angle detected by an arm relative angle sensor 62 disposed on a coupling shaft coupling the vehicle body 8 to the arm 2 and a signal representing an angle detected by a bucket relative angle sensor 63 disposed on a coupling shaft coupling the arm 2 to the bucket 3. The arm relative angle sensor (a working state detecting device) 62 is, for example, a potentiometer detecting the relative angle (an inclined angle) of the arm 2 relative to the vehicle body 8 and outputs the signal representing the detected angle to the main controller 100. Since the angle of the vehicle body 8 relative to the ground (a traveling surface) is constant, the angle detected by the arm relative angle sensor 62 corresponds to the relative angle (the inclined angle) of the arm 2 relative to the ground. The bucket relative angle sensor (the working state detecting device) 63 is, for example, a potentiometer that detects the relative angle (the inclined angle) of the bucket 3 relative to the arm 2 and outputs the signal representing the detected angle to the main controller 100.

Examples of the sensor signals input to the main controller 100 include a signal representing the vehicle speed detected by a vehicle speed sensor 61. The vehicle speed sensor (a traveling state detecting device) 61 detects the vehicle speed of the work vehicle 1 and outputs the signal representing the detected vehicle speed to the main controller 100. Furthermore, examples of the sensor signals input to the main controller 100 include signals representing rotation speeds of the engine 20, the generator motor 40, the hydraulic pressure pumps 30A, 30B, and 30C, and the traveling motor 43 detected by a plurality of rotational speed sensors and signals representing discharge pressures of the hydraulic pressure pumps 30A, 30B, and 30C, pressures (load pressures) of the hydraulic cylinders, and the like detected by a plurality of pressure sensors.

The main controller 100 outputs a front control command to the front controller 31 based on the operation direction and the operation amount of the arm operating lever 52 and the operation direction and the operation amount of the bucket operating lever 53. As described above, the front controller 31 adjusts the pressure, the speed, and the flow direction of the hydraulic oil discharged from the hydraulic pressure pump 30A based on the front control command from the main controller 100 and causes the arm cylinder 4 and the bucket cylinder 5 to operate. The front controller 31 includes a directional control valve that controls the flow of the hydraulic oil discharged from the hydraulic pressure pump 30A and a solenoid valve or the like that generates a pilot pressure input to a pilot chamber of this directional control valve.

The main controller 100 outputs a brake control command to the brake controller 32 based on the operation amount of the brake pedal 57 and the operation position of the parking brake switch 56. The brake controller 32 adjusts the pressure, the speed, and the direction of the hydraulic oil discharged from the hydraulic pressure pump 30B based on the brake control command from the main controller 100 and causes the brake cylinder 17 for functioning the brake and the parking brake cylinder 18 for functioning the parking brake to operate. The brake controller 32 includes a directional control valve that controls the flow of the hydraulic oil discharged from the hydraulic pressure pump 30B and a solenoid valve or the like that generates a pilot pressure input to a pilot chamber of this directional control valve.

The main controller 100 outputs a steering control command to the steering controller 33 based on the operation direction and the operation amount of the steering wheel 55. The steering controller 33 adjusts the pressure, the speed, and the direction of the hydraulic oil discharged from the hydraulic pressure pump 30C based on the steering control command from the main controller 100 and causes the steering cylinder 15 to operate. The steering controller 33 includes a directional control valve that controls the flow of the hydraulic oil discharged from the hydraulic pressure pump 30C and a solenoid valve or the like that generates a pilot pressure input to a pilot chamber of this directional control valve.

The inverter 41 for generator motor and the inverter 42 for traveling motor are connected via a direct current portion (a DC bus line) 44. Note that the work vehicle 1 of the embodiment does not include an electric storage device connected to the direct current portion 44. The inverter 41 for generator motor controls a bus voltage of the direct current portion 44 using an electric power supplied from the generator motor 40 based on the generated voltage command from the main controller 100. The inverter 42 for traveling motor drives the traveling motor 43 using an electric power of the direct current portion 44 based on the travel driving torque command of the main controller 100.

Here, the background that has led to the present invention will be described with reference to FIGS. 3 and 4.

Figure 3:
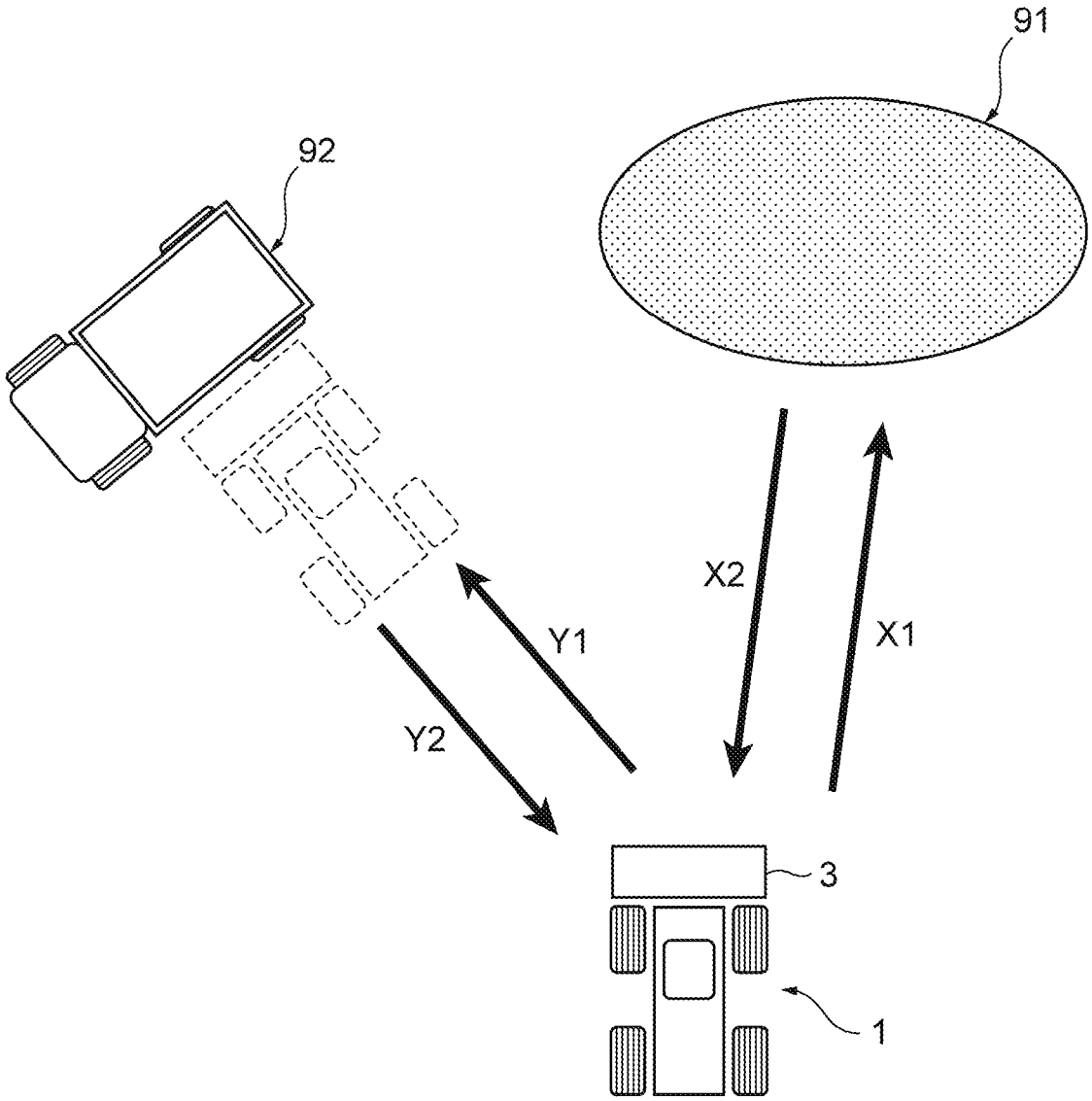
FIG. 3 is a drawing for describing a basic carrying work of the work vehicle.
Figure 4:
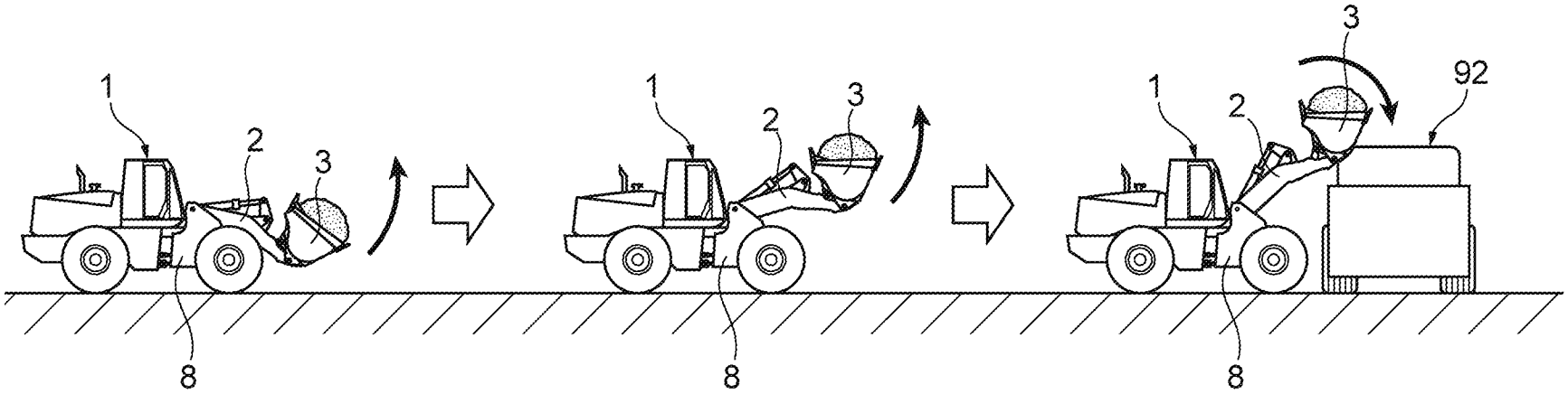
FIG. 4 is a drawing for describing an operation associated with rise/run.

FIG. 3 is a drawing for describing a basic carrying work of the work vehicle and FIG. 4 is a drawing for describing an operation associated with rise/run. In the carrying work, the work vehicle 1 excavates earth and sand, minerals, and the like (a load) and performs work to load it on a loading target 92, such as a dump truck. FIG. 3 illustrates V-shape loading as one of the methods when this carrying work is performed.

Specifically, the work vehicle 1 firstly moves forward toward an excavation target 91, such as a natural ground, as indicated by the arrow X1 in FIG. 3. Next, the work vehicle 1 causes the bucket 3 to penetrate the excavation target 91 in a manner of digging into the excavation target 91 and puts the load, such as earth and sand and minerals, in the bucket 3 by operating the arm 2 and the bucket 3. Afterwards, the work vehicle 1 scoops the load to the near side of the bucket 3 (performs the crowding motion) so as not to spill the load in the bucket 3. This completes the excavation work. After the completion of the excavation work, the work vehicle 1 once moves rearward as indicated by the arrow X2 in FIG. 3. Next, the work vehicle 1 moves forward toward the loading target 92 as indicated by the arrow Y1 in FIG. 3.

Then, as illustrated in FIG. 4, the operator of the work vehicle 1 moves the vehicle body 8 (that is, the work vehicle 1) forward toward the loading target 92 by operating the steering wheel 55 and the accelerator pedal 58 while lifting the arm 2 by operating the arm operating lever 52. Then, the vehicle body 8 is stopped before the loading target 92. In FIG. 3, the work vehicle 1 in the state of being stopped before the loading target 92 is indicated with a dashed line.

Afterwards, the operator operates the bucket operating lever 53 to cause the bucket 3 to perform a dumping motion, thereby loading the load in the bucket 3 on a loading platform of the loading target 92 (that is, dumping the load in the bucket 3). This completes the loading work. This sequence of operations illustrated in FIG. 4 is referred to as the above-described "operation associated with rise/run" and the traveling distance of the work vehicle 1 when the arm 2 is completely lifted to the height necessary for dumping during the rise/run is referred to as a "rise/run distance." After the rise/run, as indicated by the arrow Y2 in FIG. 3, the work vehicle 1 moves rearward again and returns to the original position.

The sequence of works including such excavation work and loading work is referred to as "V-shape loading," which occupies a large portion of the whole work period of the work vehicle 1. Accordingly, in order to reduce the burden on the operator, it is effective to reduce the burden from this sequence of works. Here, the burden means the number of changes in operation amounts of the operating members, such as the accelerator pedal 58 and the arm operating lever 52, made by the operator in the sequence of works including the excavation work and the loading work, and less in the number of changes means low burden on the operator.

In the loading work, the loading work with low burden on the operator and good operation efficiency and fuel efficiency is achieved when the operator operates the arm operating lever 52 to the full (full lever) at the start of the rise/run operation and operates the accelerator pedal 58 to the full (full acceleration), and the arm angle is completely lifted to the height necessary for dumping before the loading target 92 with full lever and full acceleration. Hereinafter, this operation is referred to as an "operation associated with simple rise/run."

However, as described above, when the height of the bucket is high at the start of the rise/run operation and/or when the road surface to the loading target 92 is acclivitous, performing the operation associated with simple rise/run causes the insufficient driving force (the travel driving force) of the traveling device 11 and the excessive driving force (the work driving force) of the working device 6, thereby completely lifting the arm 2 a long way before the loading target 92. That is, the rise/run distance decreases. At this time, since the work vehicle moves forward to the front of the loading target 92 in the state where the operation of the working device 6 has been terminated, the period in which only the traveling device 11 is operated increases to lower the operation efficiency and fuel efficiency. In order to avoid this, it is necessary for the operator to keep balancing between the travel driving force and the work driving force such that the arm 2 is completely lifted right before the loading target 92 by, for example, loosening the arm operating lever 52 during the rise/run operation. Accordingly, the burden on the operator is increased.

Therefore, the inventors of the present application have found, as the result of repeated intensive studies, that achieving an appropriate balance between the travel driving force and the work driving force necessary for completely lifting the arm 2 right before the loading target 92 when the operator performs the operation associated with simple rise/run allows reducing the burden on the operator.

Note that, the appropriate balance between the travel driving force and the work driving force varies by the traveling distance, the arm angle, the vehicle speed, and the arm angular speed of the work vehicle 1. The faster the arm angular speed is to the vehicle speed in the traveling distance and the arm angle at a certain time during the rise/run operation, the more it is necessary to suppress the work driving force. On the other hand, the faster the vehicle speed is to the arm angular speed in the traveling distance and the arm angle at a certain time during the rise/run operation, the more it is necessary to suppress the travel driving force. In the embodiment, adjusting the balance between the travel driving force and the work driving force based on the traveling distance, the arm angle, the vehicle speed, and the arm angular speed of the work vehicle 1 in the loading work allows achieving the reduced burden on the operator.

Figure 5:
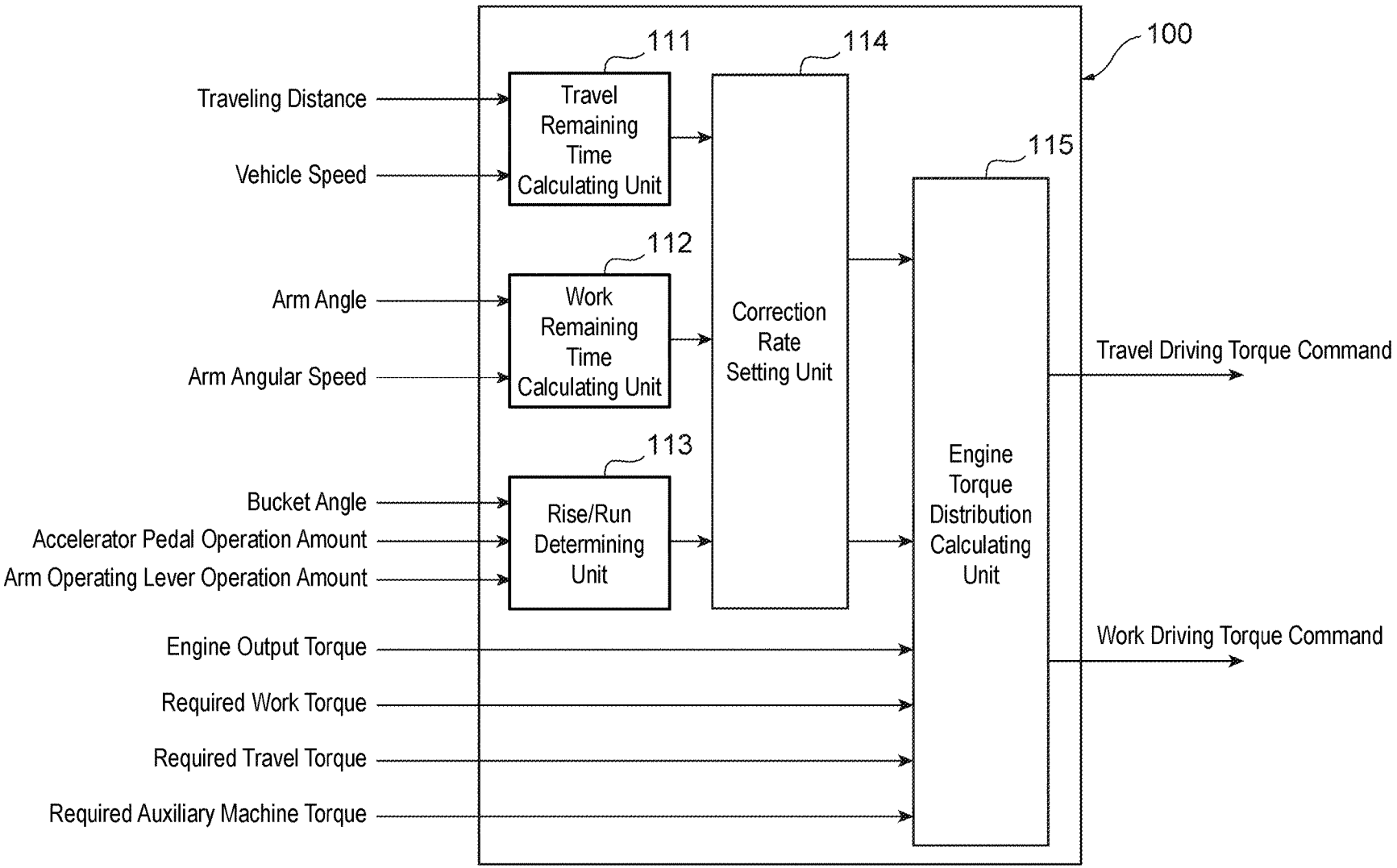
FIG. 5 is a block diagram illustrating a main controller of the work vehicle.

Therefore, as illustrated in FIG. 5, the main controller 100 of the embodiment includes a travel remaining time calculating unit 111 that calculates a remaining time until the vehicle body 8 (that is, the work vehicle 1) reaches the target rise/run distance (the target traveling distance) as a travel remaining time $t_C$, a work remaining time calculating unit 112 that calculates a remaining time until the arm 2 reaches the target arm angle as a work remaining time $t_1$, a rise/run determining unit 113 that determines whether the work vehicle 1 is in a state of performing the rise/run in the loading work or not, a correction rate setting unit 114 that sets a travel correction rate $\eta_C$ for adjusting a travel driving torque and a work correction rate for adjusting a work driving torque based on the travel remaining time $t_C$ calculated in the travel remaining time calculating unit 111, the work remaining time $t_I$ calculated in the work remaining time calculating unit 112, and a rise/run determination flag determined in the rise/run determining unit 113, and an engine torque distribution calculating unit 115 that calculates the travel driving torque command for controlling the travel driving torque and the work driving torque command for controlling the work driving torque based on the travel correction rate $\eta_C$ and the work correction rate set by the correction rate setting unit 114.

The travel remaining time calculating unit 111 calculates the remaining time $t_C$ based on the traveling distance and the vehicle speed of the work vehicle 1. The travel remaining time $t_C$ is, for example, calculated by the following formula (1).

$$t_C = \frac{d_{RR} - d_1}{v_1}, \tag{1}$$

In the formula (1), $d_{RR}$ is a target rise/run distance, $d_1$ is a traveling distance from a rise/run starting time $t_0$ to a time $t_I$ after a lapse of a predetermined time, and $v_1$ is a vehicle speed of the work vehicle 1 at the time $t_1$. The target rise/run distance has been preliminarily set based on an experience point and the like, and, for example, the operator sets the target rise/run distance based on the experience point so far and inputs the set target rise/run distance to the main controller 100. The vehicle speed of the work vehicle 1 is detected by the above-described vehicle speed sensor 61. Note that the vehicle speed of the work vehicle 1 may be calculated based on information detected by a rotary encoder (a traveling state detecting device) that detects a rotation speed of a shaft constituting the power transmission device.

On the other hand, the traveling distance may be calculated based on the rotation speed and the number of revolutions of the traveling motor 43 or may be calculated based on the vehicle speed and the traveling time detected by the vehicle speed sensor 61.

The work remaining time calculating unit 112 calculates the work remaining time $t_I$ based on the arm angle and the arm angular speed of the work vehicle 1. The work remaining time $t_I$ is, for example, calculated by the following formula (2).

$$t_I = \frac{\theta_{RR} - \theta_1}{v_{\theta 1}}, \tag{2}$$

In the formula (2), ORR is a target arm angle, $\theta_1$ is an arm angle from the rise/run starting time $t_0$ to the time $t_I$ after the lapse of the predetermined time, $v_{\theta 1}$ is an arm angular speed of the work vehicle 1 at the time $t_1$. The target arm angle is preliminarily set based on the height of the loading platform of the loading target 92. The arm angle is detected by the arm relative angle sensor 62. The arm angular speed is calculated by the main controller 100 based on the arm angle detected by the arm relative angle sensor 62.

The rise/run determining unit 113 determines whether a specific condition that identifies the lifting of the arm 2 during the forward traveling of the vehicle body 8 in the loading work is satisfied or not based on the traveling state of the vehicle body 8 and the working state of the working device 6 detected by the sensors and the like. In the embodiment, the rise/run determining unit 113 determines whether the work vehicle 1 is in the state of performing the rise/run operation or not based on the operation state of the accelerator pedal 58 detected by the sensor and the like and the states of the arm 2 and the bucket 3 detected by the sensors and the like. More specifically, the rise/run determining unit 113 determines whether the work vehicle 1 is in the state of performing the rise/run operation or not based on the bucket angle θ, the operation amount of the accelerator pedal 58, and the operation amount of the arm operating lever 52.

Figure 6:
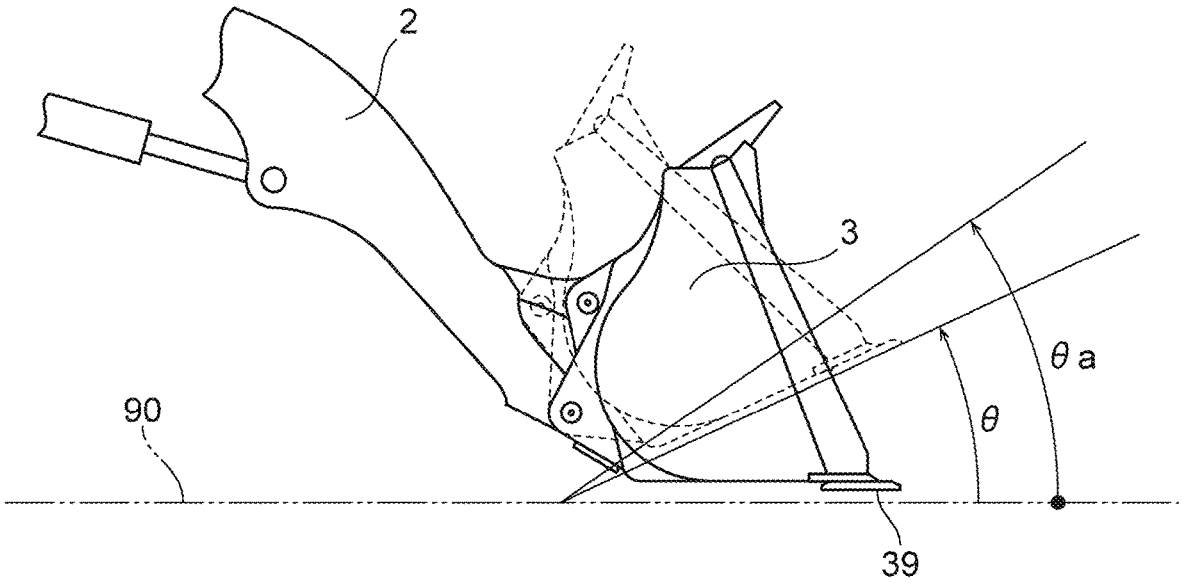
FIG. 6 is a drawing for describing a bucket angle.

FIG. 6 is a drawing for describing the bucket angle. As illustrated in FIG. 6, the bucket angle θ is an inclination angle of the bucket 3 from a reference surface 90. In the embodiment, the reference surface 90 is a surface set to be parallel to the ground (the traveling surface). When the bottom surface of a cutting part 39 of the bucket 3 is in a state parallel to the reference surface 90, the bucket angle θ is 0°. When the bucket 3 is turned by the crowd operation, the bucket angle θ is increased in accordance with the turn. In other words, when the bucket 3 is tuned by the dumping motion, the bucket angle θ is decreased in accordance with the turn. This bucket angle θ is calculated by the main controller 100 based on the relative angle of the arm 2 relative to the reference surface 90 detected by the above-described arm relative angle sensor 62 and the relative angle of the bucket 3 relative to the arm 2 detected by the above-described bucket relative angle sensor 63.

The rise/run determining unit 113 determines that the rise/run is started to set the rise/run determination flag to ON when the bucket angle θ is equal to or more than a first angle threshold value $\theta_a$ determined in advance and when the operation amounts of the accelerator pedal 58 and the arm operating lever 52 are increased. The rise/run determination flag is set to ON when the work vehicle 1 is in the state of performing the rise/run and is set to OFF when the rise/run is terminated.

The first angle threshold value $\theta_a$ is a threshold value used in the determination of the rise/run start, is set based on the scooping posture of the working device 6, and is preliminarily stored in the ROM 102 of the main controller 100. The scooping posture of the working device 6 is a posture in which the upper surface of the bucket 3 is approximately parallel to the ground.

The rise/run determining unit 113 determines that the rise/run is terminated to set the rise/run determination flag to OFF when the bucket angle θ is equal to or less than a second angle threshold value $\theta_b$ (for example, 0° or less) after it is determined that the rise/run has been started.

The second angle threshold value $\theta_b$ is a threshold value for determining whether the rise/run is terminated or not after the rise/run has been started, and, for example, the bucket angle θ when the bucket 3 is in the state of being in the dumping posture after the dumping motion of the bucket 3 is completed can be employed for the second angle threshold value $\theta_b$. That is, the rise/run determining unit 113 determines that the rise/run is terminated when the bucket 3 is detected to be in the dumping posture after it is determined that the rise/run has been started. Note that, here, the rise/run may be determined to be terminated when the operation amounts of the accelerator pedal 58 and the arm operating lever 52 become 0.

The correction rate setting unit 114 sets the travel correction rate $\eta_C$ and the work correction rate $\eta_I$ based on the travel remaining time $t_C$ calculated by the travel remaining time calculating unit 111, the work remaining time $t_I$ calculated by the work remaining time calculating unit 112, and the rise/run determination flag determined by the rise/run determining unit 113, when the mode changeover switch 54 is set to the AUTO mode. The travel correction rate $\eta_C$ and the work correction rate $\eta_I$ each take a value of 0 to 100%.

Specifically, the correction rate setting unit 114 firstly calculates a remaining time difference $\Delta t_{C-I}$ as shown in the following formula (3) based on the travel remaining time $t_C$ calculated by the travel remaining time calculating unit 111 and the work remaining time $t_I$ calculated by the work remaining time calculating unit 112.

[Math. 3]

$$\Delta t_{C-I} = t_C - t_1 \tag{3}$$

Figure 7:
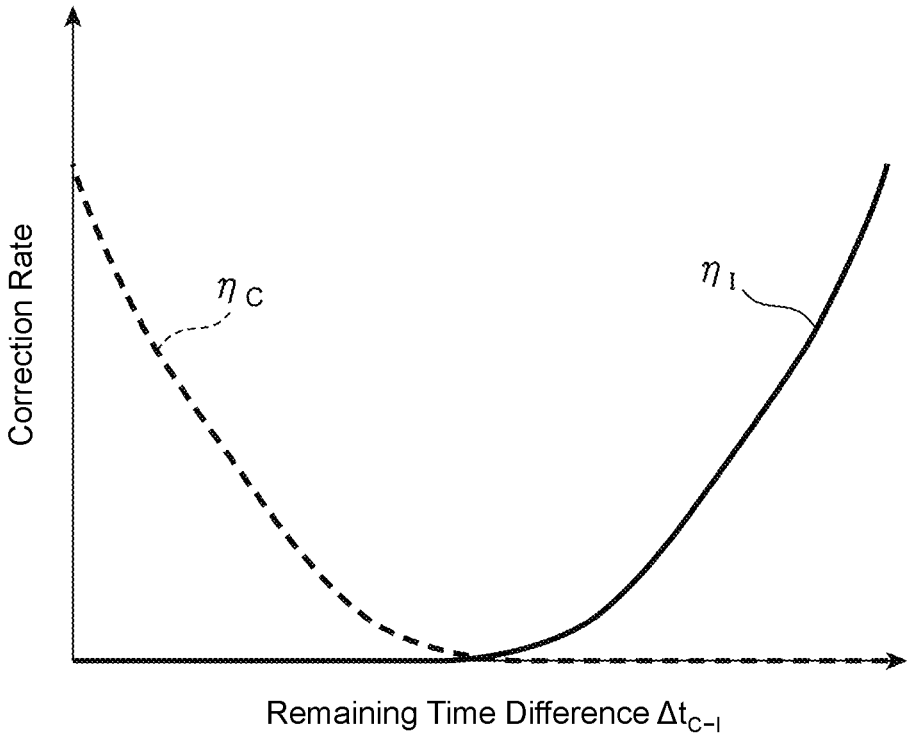
FIG. 7 is a drawing illustrating an exemplary table for setting a correction rate.

Next, the correction rate setting unit 114 sets the travel correction rate $\eta_C$ and the work correction rate $\eta_I$ based on the calculated remaining time difference $\Delta t_{C-I}$ and a correction rate table generated in advance. FIG. 7 is an exemplary correction rate table for setting the travel correction rate $\eta_C$ and the work correction rate $\eta_I$. In FIG. 7, the dashed line indicates a table in which the remaining time difference $\Delta t_{C-I}$ is associated with the travel correction rate $\eta_C$ and the solid line indicates a table in which the remaining time difference $\Delta t_{C-I}$ is associated with the work correction rate $\eta_I$.

The correction rate table illustrated in FIG. 7 is preliminarily generated based on experimental data and the like and is preliminarily stored in the ROM 102 of the main controller 100. As illustrated in FIG. 7, the larger the remaining time difference $\Delta t_{C-I}$ is, the larger the work correction rate becomes, and the smaller the remaining time difference $\Delta t_{C-I}$ is, the larger the travel correction rate $\eta_C$ becomes. Accordingly, when the operation associated with simple rise/run is performed during the loading work of the work vehicle 1, the shorter the work remaining time $t_I$ is than the travel remaining time $t_C$, the larger the work correction rate $\eta_I$ becomes, and thus, the work driving torque (the work driving force) can be promptly reduced. As a result, the lifting speed of the arm 2 is significantly restricted. On the other hand, the longer the work remaining time $t_I$ is than the travel remaining time $t_C$, the larger the travel correction rate $\eta_C$ becomes, and thus, the travel driving torque (the travel driving force) can be promptly reduced. As a result, the vehicle speed of the work vehicle 1 is significantly restricted.

While the operation associated with the rise/run is performed, the travel remaining time $t_C$ calculated by the travel remaining time calculating unit 111 and the work remaining time $t_I$ calculated by the work remaining time calculating unit 112 change, and therefore, the travel correction rate $\eta_C$ and the work correction rate $\eta_I$ set based on the travel remaining time $t_C$ and the work remaining time $t_I$ also change.

On the other hand, when the mode changeover switch 54 is set to the MANUAL mode, the correction rate setting unit 114 is inhibited from executing the setting of the travel correction rate $\eta_C$ and the work correction rate $\eta_I$. In this case, the travel correction rate $\eta_C$ and the work correction rate $\eta_I$ are kept at constant values (for example, approximately 0%).

The engine torque distribution calculating unit 115 calculates a work driving torque command $T_{I_COM}$ and a travel driving torque command $T_{C_COM}$ based on the correction rates $\eta_C$ and $\eta_I$ set by the correction rate setting unit 114, an engine output torque $T_E$, a required auxiliary machine torque $T_{AUX_REQ}$, a required work torque $T_{I_REQ}$, and a required travel torque $T_{C_REQ}$.

The engine output torque $T_E$, the required auxiliary machine torque $T_{AUX_REQ}$, the required work torque $T_{I_REQ}$, and the required travel torque $T_{C_REQ}$ are each calculated by the main controller 100. The engine output torque $T_E$ is the maximum torque outputtable at the current engine rotation speed. The main controller 100, for example, calculates the engine output torque $T_E$ based on the engine rotation speed detected by the engine rotation speed sensor by referencing the engine output torque curve stored in the ROM 102.

The required auxiliary machine torque $T_{AUX_REQ}$ is calculated corresponding to operating states of a plurality of auxiliary machines that operate with the electric power generated by the generator motor 40. The main controller 100 sets a target value (for example, 1800 rpm) of the engine rotation speed. The target value of the engine rotation speed set by the main controller 100 is output to an engine controller (not illustrated). The engine controller controls a fuel injection device (not illustrated) such that the engine rotation speed detected by the engine rotation speed sensor becomes the target value.

Figure 8A:
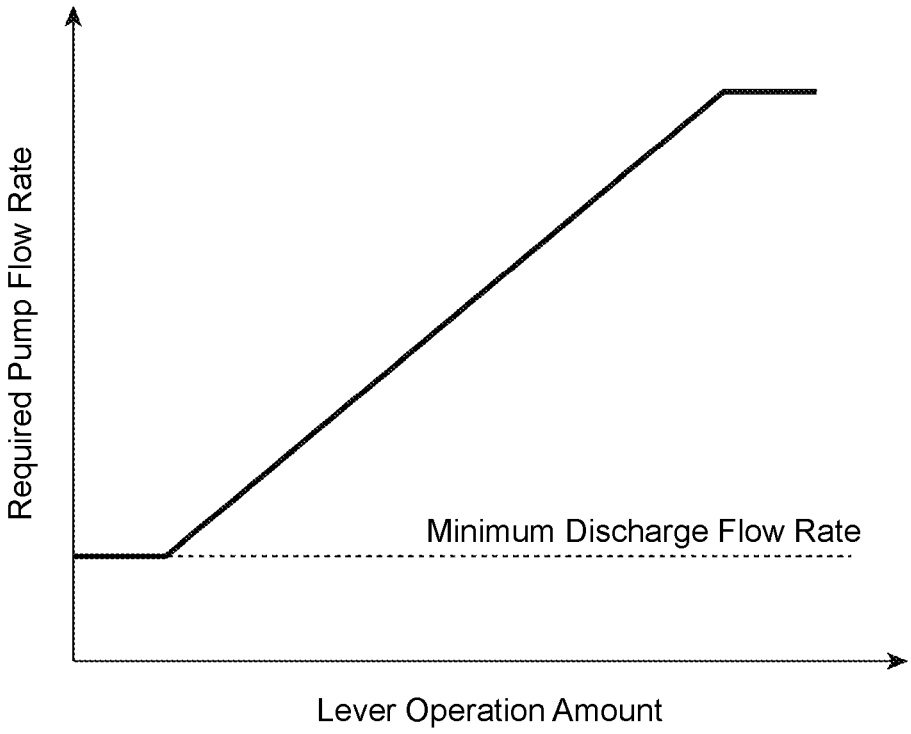
FIG. 8A is a drawing showing a relation between a lever operation amount and a required pump flow rate.

The main controller 100 calculates the required work torque $T_{I_REQ}$ based on the operation amount of the arm operating lever 52 and the operation amount of the bucket operating lever 53. FIG. 8A is an exemplary required pump map showing a relation between the lever operation amount and the required pump flow rate. This required pump map is preliminarily stored in the ROM 102 of the main controller 100. The main controller 100 firstly refers to the required pump flow rate map illustrated in FIG. 8A and determines a required pump flow rate based on a lever operation amount (a lever signal). The required pump flow rate map is set such that the required pump flow rate is approximately proportionate to the lever operation amount, and the required pump flow rate increases as the lever operation amount increases. Note that the required pump flow rate map has a map based on the operation amount of the arm operating lever 52 and a map based on the operation amount of the bucket operating lever 53, and the larger one out of the flow rates determined by the respective maps is determined to be the required pump flow rate.

Next, the main controller 100 calculates a required hydraulic pressure power based on the above-described required pump flow rate and the discharge pressure of the hydraulic pressure pump 30A detected by the pressure sensor, and calculates the required work torque $T_{I_REQ}$ based on the calculated required hydraulic pressure power and the rotation speed of the engine 20 detected by the rotational speed sensor. The required work torque $T_{I_REQ}$ increases as the lever operation amount increases.

Figure 8B:
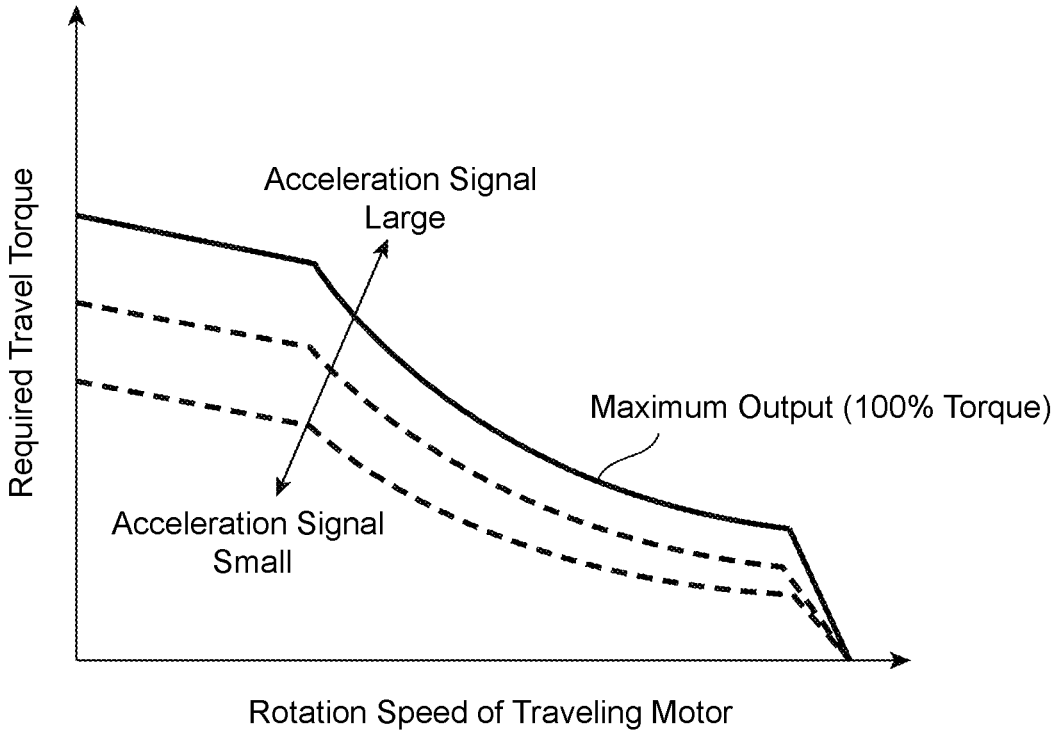
FIG. 8B is a drawing showing a relation between a rotation speed and a required travel torque of a traveling motor.

The main controller 100 calculates the required travel torque $T_{C_REQ}$ based on the rotation speed of the traveling motor 43 and the operation amount (the acceleration signal) of the accelerator pedal 58. FIG. 8B is an exemplary torque map of the traveling motor 43 showing a relation between the rotation speed of the traveling motor and the required travel torque. This torque map is preliminarily stored in the ROM 102 of the main controller 100. The ROM 102 stores a plurality of torque maps (torque curves) corresponding to the acceleration signals such that the torque of the traveling motor 43 increases and decreases corresponding to the increase and decrease of the acceleration signal. The torque map is set such that the required travel torque $T_{C_REQ}$ increases as the acceleration signal increases and the required travel torque $T_{C_REQ}$ decreases as the rotation speed of the traveling motor 43 increases.

The main controller 100 selects the torque map (the torque curve) corresponding to the magnitude of the acceleration signal (the magnitude of the operation amount of the accelerator pedal 58) and calculates the required travel torque $T_{C_REQ}$ based on the rotation speed of the traveling motor 43. For example, when the accelerator pedal 58 is operated fully (when the acceleration signal is maximum), the torque map in the solid line (see FIG. 8B) is selected. The main controller 100 refers to the selected torque map and calculates the required travel torque $T_{C_REQ}$ based on the rotation speed of the traveling motor 43. Note that, when a transmission is provided, the main controller 100 calculates the required travel torque $T_{C_REQ}$ by considering the gear ratio of the transmission.

The engine torque distribution calculating unit 115 firstly calculates a work target torque $T_{I_TGT}$ based on the required work torque $T_{I_REQ}$ calculated by the main controller 100 and the correction rate $\eta_I$ of the work driving torque set by the correction rate setting unit 114. The work target torque $T_{I_TGT}$ is, for example, calculated by the formula (4).

[Math. 4]

$$T_{I_TGT}=T_{I_REQ}\times(1-\eta_I) \tag{4}$$

The engine torque distribution calculating unit 115 calculates the travel target torque $T_{C_TGT}$ based on the required travel torque $T_{C_REQ}$ calculated by the main controller 100 and the correction rate $\eta_C$ of the travel driving torque set by the correction rate setting unit 114. The travel target torque $T_{C_TGT}$ is calculated by the formula (5).

[Math. 5]

$$T_{C_TGT}=T_{C_REQ}\times(1-\eta C) \tag{5}$$

Next, the engine torque distribution calculating unit 115 calculates a target torque summed value $T_{SUM_TGT}$ ($T_{SUM_TGT}=T_{I_TGT}+T_{C_TGT}+T_{AUX_REQ}$) summing the work target torque $T_{I_TGT}$, the travel target torque $T_{C_TGT}$, and the required auxiliary machine torque $T_{AUX_REQ}$. When the target torque summed value $T_{SUM_TGT}$ is the engine output torque $T_E$ or less, the engine torque distribution calculating unit 115 determines the work target torque $T_{I_TGT}$ as the work driving torque command $T_{I_COM}$ and determines the travel target torque $T_{C_TGT}$ as the travel driving torque command $T_{C_COM}$.

On the other hand, when the target torque summed value $T_{SUM_TGT}$ is larger than the engine output torque $T_E$, the engine torque distribution calculating unit 115 determines the work driving torque command $T_{I_COM}$ and the travel driving torque command $T_{C_COM}$ such that a command torque summed value $T_{SUM_COM}$ summing the work driving torque command $T_{I_COM}$, the travel driving torque command $T_{C_COM}$, and the required auxiliary machine torque $T_{AUX_REQ}$ does not exceed the engine output torque $T_E$. An example of the determination method will be described below.

The engine torque distribution calculating unit 115 determine a predetermined value Y such that a sum ($C_I$+$C_C$) of a work driving torque correction value $C_I$ obtained by multiplying the predetermined value Y by the work correction rate and a travel driving torque correction value $C_C$ obtained by multiplying the predetermined value Y by the travel correction rate $\eta_C$ becomes equal to the amount of the target torque summed value $T_{SUM_TGT}$ exceeding the engine output torque $T_E$ ($T_{SUM_TGT}$−$T_E$).

At this time, the engine torque distribution calculating unit 115 determines the value obtained by subtracting the work driving torque correction value $C_I$ from the work target torque $T_{I_TG}$ as the work driving torque command $T_{I_COM}$ and determines the value obtained by subtracting the travel driving torque correction value $C_C$ from the travel target torque $T_{C_TGT}$ as the travel driving torque command $T_{C_COM}$. This determines the work driving torque command $T_{I_COM}$ and the travel driving torque command $T_{C_COM}$ such that the ratio of the work driving torque command $T_{I_COM}$ to the travel driving torque command $T_{C_COM}$ is not changed and the command torque summed value $T_{SUM_COM}$ does not exceed the engine output torque $T_E$.

Note that the determination method of the work driving torque command $T_{I_COM}$ and the travel driving torque command $T_{C_COM}$ when the target torque summed value $T_{SUM_TGT}$ is larger than the engine output torque $T_E$ is not limited to this. For example, the engine torque distribution calculating unit 115 may determine the work driving torque command $T_{I_COM}$ and the travel driving torque command $T_{C_COM}$ such that the command torque summed value $T_{SUM_COM}$ does not exceed the engine output torque $T_E$ by performing a correction that subtracts only one of the work target torque $T_{I_TGT}$ or the travel target torque $T_{C_TGT}$.

Figure 9:
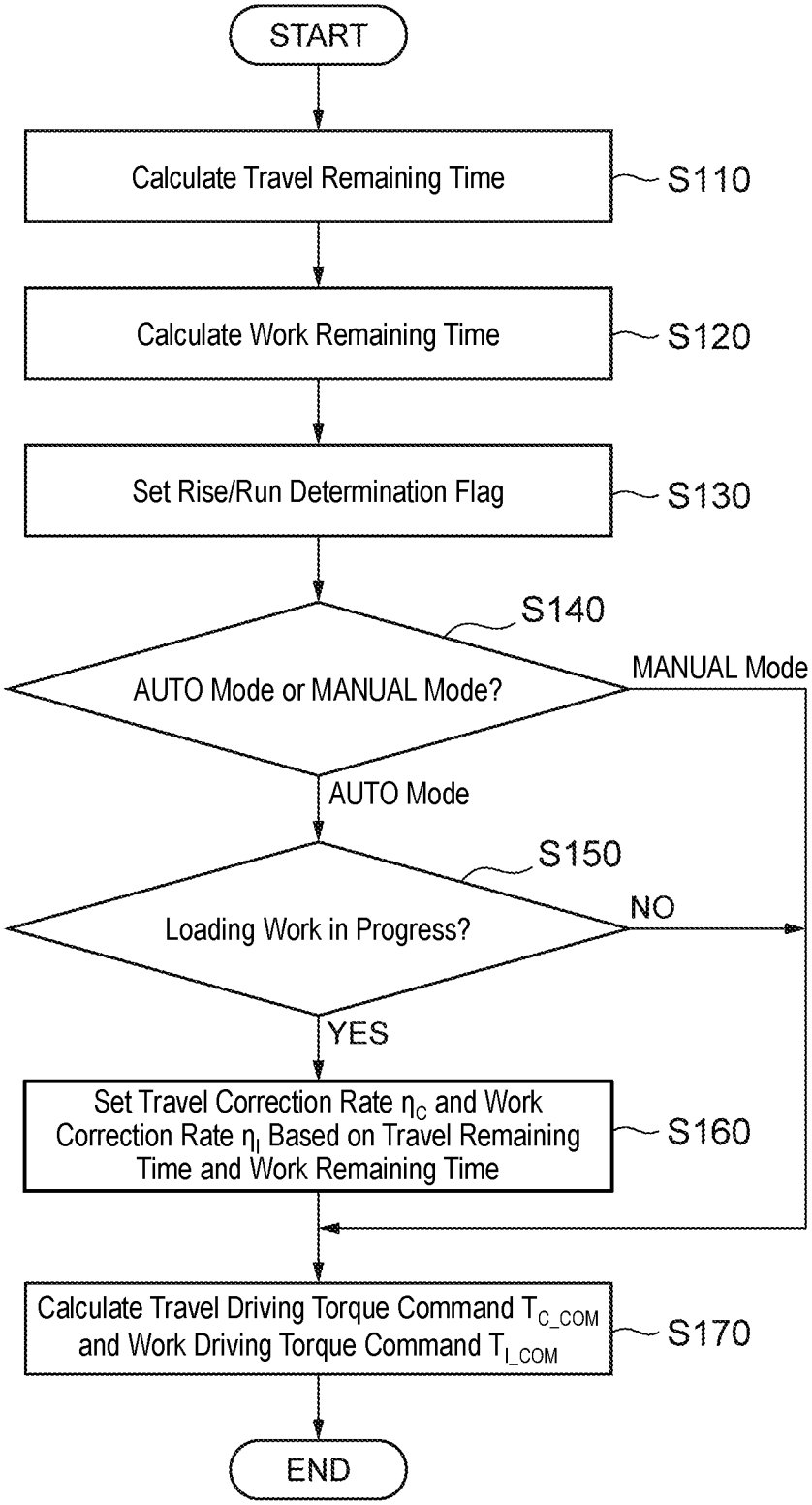
FIG. 9 is a flowchart illustrating control processing of the main controller.

The following describes control processing of the main controller 100 with reference to FIG. 9. The control processing of the main controller 100 illustrated in FIG. 9 is, for example, started by an ignition switch (an engine key switch) being turned ON and is repeatedly executed at a predetermined control cycle after initial setting, which is not illustrated, is performed. Note that, in the initial setting, the rise/run determination flag is set to OFF.

At Step S110, the travel remaining time calculating unit 111 calculates the travel remaining time $t_C$ as described above.

At Step S120 subsequent to Step S110, the work remaining time calculating unit 112 calculates the work remaining time $t_I$ as described above.

At Step S130 subsequent to Step S120, the rise/run determining unit 113 performs the setting processing of the rise/run determination flag. At this time, the rise/run determining unit 113 determines that the rise/run is not started when bucket angle θ is not equal to or more than the first angle threshold value θa or when a bottom pressure of the arm cylinder 4 is less than the pressure threshold value determined in advance. In this case, the rise/run determining unit 113 keeps the rise/run determination flag remaining OFF.

On the other hand, when the bucket angle θ is equal to or more than the first angle threshold value θa and the bottom pressure of the arm cylinder 4 is equal to or more than the pressure threshold value determined in advance, the rise/run determining unit 113 determines that the rise/run is started. In this case, the rise/run determining unit 113 switches the rise/run determination flag from OFF to ON.

When the setting processing of the rise/run determination flag is completed, the control processing proceeds to Step S140. At Step S140, the main controller 100 determines whether the mode changeover switch 54 is set to the AUTO mode or the MANUAL mode. When it is determined that the mode changeover switch 54 is set to the AUTO mode, the control processing proceeds to Step S150. On the other hand, when it is determined that the mode changeover switch 54 is set to the MANUAL mode, the control processing proceeds to Step S170.

At Step S150, the main controller 100 determines whether the work vehicle 1 is in the middle of loading work or not (in other words, whether the work vehicle 1 is in the state of performing the rise/run or not). When the rise/run determination flag is set to ON, it is determined that the work vehicle 1 is in the middle of loading work (in other words, the work vehicle 1 is in the state of performing the rise/run), and the control processing proceeds to Step S160. On the other hand, when the rise/run determination flag is set to OFF, it is determined that the work vehicle 1 is not in the middle of loading work (in other words, the work vehicle 1 is not in the state of performing the rise/run), and the control processing proceeds to Step S170.

At Step S160, the correction rate setting unit 114 sets the travel correction rate $\eta_C$ and the work correction rate $\eta_I$ based on the travel remaining time $t_C$ and the work remaining time $t_I$ as described above.

At Step S170 subsequent to Step S160, the engine torque distribution calculating unit 115 calculates the work driving torque command $T_{I_COM}$ and the travel driving torque command $T_{C_COM}$ based on the correction rates $\eta_C$ and $\eta_I$, the engine output torque $T_E$, the required auxiliary machine torque $T_{AUX_REQ}$, the required work torque $T_{I_REQ}$, and the required travel torque $T_{C_REQ}$ as described above. Thus, a sequence of the control processing is terminated.

The work driving torque command $T_{I_COM}$ calculated by the engine torque distribution calculating unit 115 is output to a pump controller, which is not illustrated. The pump controller generates a control signal for controlling discharge capacity (a displacement volume) of the hydraulic pressure pump 30A based on the work driving torque command $T_{I_COM}$ and the discharge pressure of the hydraulic pressure pump 30A. The pump controller outputs a generated control signal to a regulator, which is not illustrated, and therefore, the discharge capacity of the hydraulic pressure pump 30A is controlled. Accordingly, the arm 2 is driven by the work driving force generated in the arm cylinder 4 and the bucket 3 is driven by the work driving force generated in the bucket cylinder 5. Thus, the main controller 100 of the embodiment sets the work correction rate $\eta_I$ based on the travel remaining time $t_C$ and the work remaining time $t_I$ during the rise/run and calculates and outputs the work driving torque command $T_{I_COM}$ based on the set work correction rate thereby controlling the work driving torque.

The travel driving torque command $T_{C_COM}$ calculated by the engine torque distribution calculating unit 115 is output to the inverter 42 for traveling motor. The inverter 42 for traveling motor drives the traveling motor 43 based on the travel driving torque command $T_{C_COM}$. The torque generated by the traveling motor 43 is transmitted to the wheels 7 constituting the traveling device 11 via the power transmission device constituting the traveling device 11. Accordingly, the traveling device 11 is driven by the travel driving force generated by the traveling motor 43. Thus, the main controller 100 according to the embodiment sets the travel correction rate $\eta_C$ based on the travel remaining time $t_C$ and the work remaining time $t_I$ during the rise/run and calculates and outputs the travel driving torque command $T_{C_COM}$ based on the set travel correction rate $\eta_C$, thereby controlling the travel driving torque.

Figure 10:
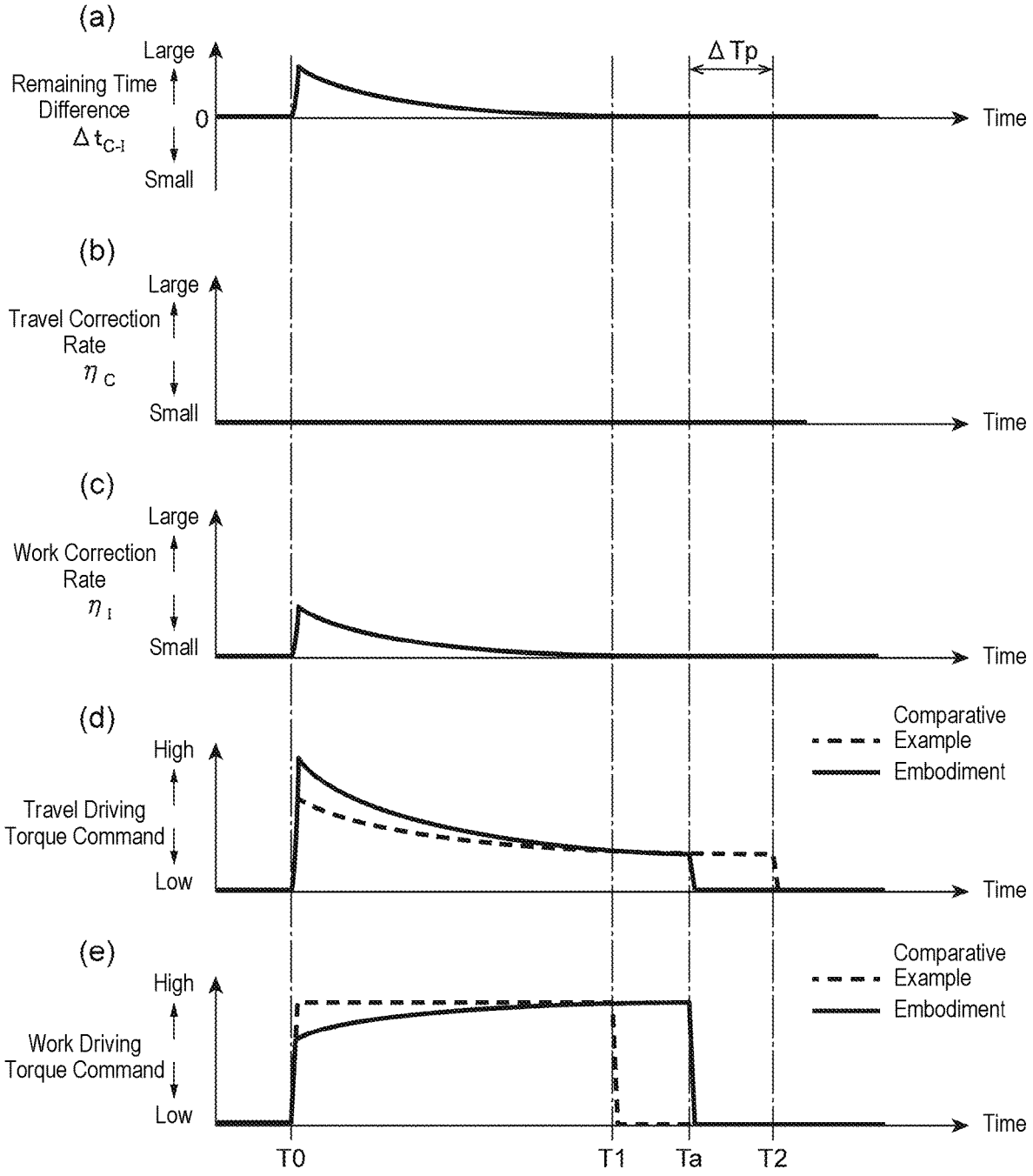
FIG. 10 is a drawing for describing effects (comparisons with Comparative Example) of the work vehicle according to the first embodiment.

The following describes the operational advantage of the work vehicle 1 according to the embodiment with reference to FIG. 10. FIG. 10 illustrates an example in which the case where the road surface to the loading target is acclivitous is assumed and the work vehicle 1 according to the embodiment performs the operation associated with simple rise/run. For more clarification of the operational advantage of the embodiment, the description will be given with comparison with Comparative Example without the AUTO mode (that is, a conventional example not considering the correction rate $\eta_C$ or $\eta_I$). Note that, in the work vehicle 1 according to the embodiment and Comparative Example, the operational procedures and operation amounts by the operator on the various kinds of operating members are the same.

In FIG. 10, the operation of the main controller 100 of the work vehicle 1 according to the embodiment is indicated by the solid line and the operation of the main controller according to Comparative Example is indicated by the dashed line. The horizontal axes in FIG. 10 indicate times (elapsed times). The vertical axis in FIG. 10(*a*) indicates the remaining time difference $\Delta t_{C\text{-}I}$ calculated by the correction rate setting unit 114, the vertical axis in FIG. 10(*b*) indicates the travel correction rate $\eta_C$ set by the correction rate setting unit 114, the vertical axis in FIG. 10(*c*) indicates the work correction rate $\eta_I$ set by the correction rate setting unit 114, the vertical axis in FIG. 10(*d*) indicates the travel driving torque command $T_{C_COM}$ calculated by the engine torque distribution calculating unit 115, and the vertical axis in FIG. 10(*e*) indicates the work driving torque command $T_{I_COM}$ calculated by the engine torque distribution calculating unit 115.

In FIG. 10, Time T0 is the time at which the operator started the operation associated with simple rise/run and the work vehicle 1 started lifting the arm 2 and moving the vehicle body 8 forward. That is, Time T0 is the time at which the rise/run determination flag was set to ON. Time T1 is the time at which the arm 2 was lifted to the height necessary for dumping in Comparative Example. Time T2 is the time at which the vehicle body 8 was moved forward to the target rise/run distance in Comparative Example. Time Ta is the time at which the arm 2 was lifted to the height necessary for dumping and the vehicle body 8 was moved forward to the target rise/run distance according to the embodiment.

As illustrated in FIG. 10(*a*), the remaining time difference $\Delta t_{C\text{-}I}$ is small until Time T0. This is because the work vehicle 1 has not started the rise/run until Time T0. At Time T0, the remaining time difference $\Delta t_{C\text{-}I}$ varies since the work vehicle 1 lifts the arm 2 and drives the vehicle body 8 forward. Here, since the case where the road surface to the loading target is acclivitous is assumed, the travel remaining time $t_C$ is longer than the work remaining time and thus, the remaining time difference $\Delta t_{C\text{-}I}$ sharply increases.

As illustrated in FIG. 10(*b*), in the embodiment, from the time the rise/run determination flag is set to ON until it is set to OFF (Time T0 to Time Ta), that is, while the main controller 100 determines that the rise/run is being performed, the remaining time difference $\Delta t_{C\text{-}I}$ is large, and therefore, the travel correction rate $\eta_C$ remains small (in other words, remains low). In view of this, as illustrated in FIG. 10(*d*), the travel driving torque command of the embodiment is higher than that of Comparative Example for the entire period.

On the other hand, as illustrated in FIG. 10(*c*), in the embodiment, after Time T0 until the remaining time difference $\Delta t_{C\text{-}I}$ becomes 0, the work correction rate $\eta_I$ increases. Accordingly, as illustrated in FIG. 10(*e*), after Time T0 until the remaining time difference $\Delta t_{C\text{-}I}$ becomes 0, the work driving torque command of the embodiment is lower than that in Comparative Example.

As illustrated in FIG. 10(*e*), in the embodiment, by the amount of the work driving torque command lower than that of Comparative Example, the target torque summed value $T_{SUM_TGT}$ is smaller than that of Comparative Example. Therefore, the engine output that can be distributed to the travel driving torque command increases, and as illustrated in FIG. 10(*d*), the travel driving torque command of the embodiment is higher than Comparative Example.

As described above, in the situation where the vehicle speed has difficulty in increasing by the influence of the inclined angle of the road surface to the loading target, when the operation associated with simple rise/run is performed, Time T2 at which the forward driving of Comparative Example is completed is longer than Time T1 at which the arm lifting is completed. That is, Comparative Example is in the state where, even though the arm is completely lifted in the early stage, the traveling takes time and the time for approaching the loading target 92 (the dump truck) is wastefully spent. Accordingly, in Comparative Example, in order to align the time at which the forward traveling is completed and the time at which the arm lifting is completed, the operator needs to adjust the arm operating lever according to the traveling distance, the vehicle speed, the arm angle, and the arm angular speed of the vehicle body. As a result, the burden on the operator is increased.

In contrast, with the work vehicle 1 according to the embodiment, the main controller 100 sets the travel correction rate $\eta_C$ and the work correction rate $\eta_I$ based on the traveling distance, the vehicle speed, the arm angle, and the arm angular speed of the vehicle body and keeps the balance between the work driving torque command and the travel driving torque command based on the set travel correction rate $\eta_C$ and work correction rate and therefore, the time at which the arm lifting is completed is longer than that in Comparative Example and the time at which the forward traveling is completed is shorter than that in Comparative Example. Accordingly, with the work vehicle 1 according to the embodiment, even when the operation associated with simple rise/run is performed, the time at which the forward traveling is completed and the time at which the arm lifting is completed can be aligned, and therefore, the burden on the operator can be reduced.

The balance between the work driving torque command and the travel driving torque command are thus kept, and therefore, the time needed for the rise/run of the work vehicle 1 of the embodiment is short compared with Comparative Example ($\Delta T_P$=T2−Ta, see FIG. 10) and the operation efficiency of the loading work of the work vehicle 1 can be improved. Furthermore, by the amount of shortened time needed for the rise/run, the engine torque supplied to the engine, the hydraulic pressure pump, the electric generator, and the like can be saved, and therefore, the fuel efficiency can be improved compared with Comparative Example.

As described above, with the work vehicle 1 of the embodiment, since the correction rates $\eta_C$ and $\eta_I$ are set based on the traveling distance, the vehicle speed, the arm angle, and the arm angular speed of the work vehicle 1 when the rise/run is performed, the time at which the arm lifting is completed and the time at which the forward traveling is completed during the rise/run can be brought close to equal irrespective of the operator's skill. As a result, the reduced burden on the operator, the improved operation efficiency, and the improve fuel efficiency can be achieved.

Since both the travel driving torque and the work driving torque are adjusted with the correction rates $\eta_C$ and $\eta_I$, even if the time at which the arm lifting is completed is later than the time at which the forward traveling is completed, the time at which the arm lifting is completed and the time at which the forward traveling is completed can be brought close to equal, and therefore, the burden on the operator can be reduced. Furthermore, since both the travel driving torque and the work driving torque are sequentially adjusted with the correction rates $\eta_C$ and $\eta_I$, even in the case of the road surface condition with different inclined angles in its course, the burden on the operator can be reduced. Furthermore, with the work vehicle 1 of the embodiment, even when the amount of the load in the bucket 3 and the road surface condition change in each loading cycle or change on the real-time basis during the rise/run operation, the balance between the travel driving torque and the work driving torque can be brought close to an appropriate value, and therefore, the burden on the operator can be reduced.

Second Embodiment

Figure 11:
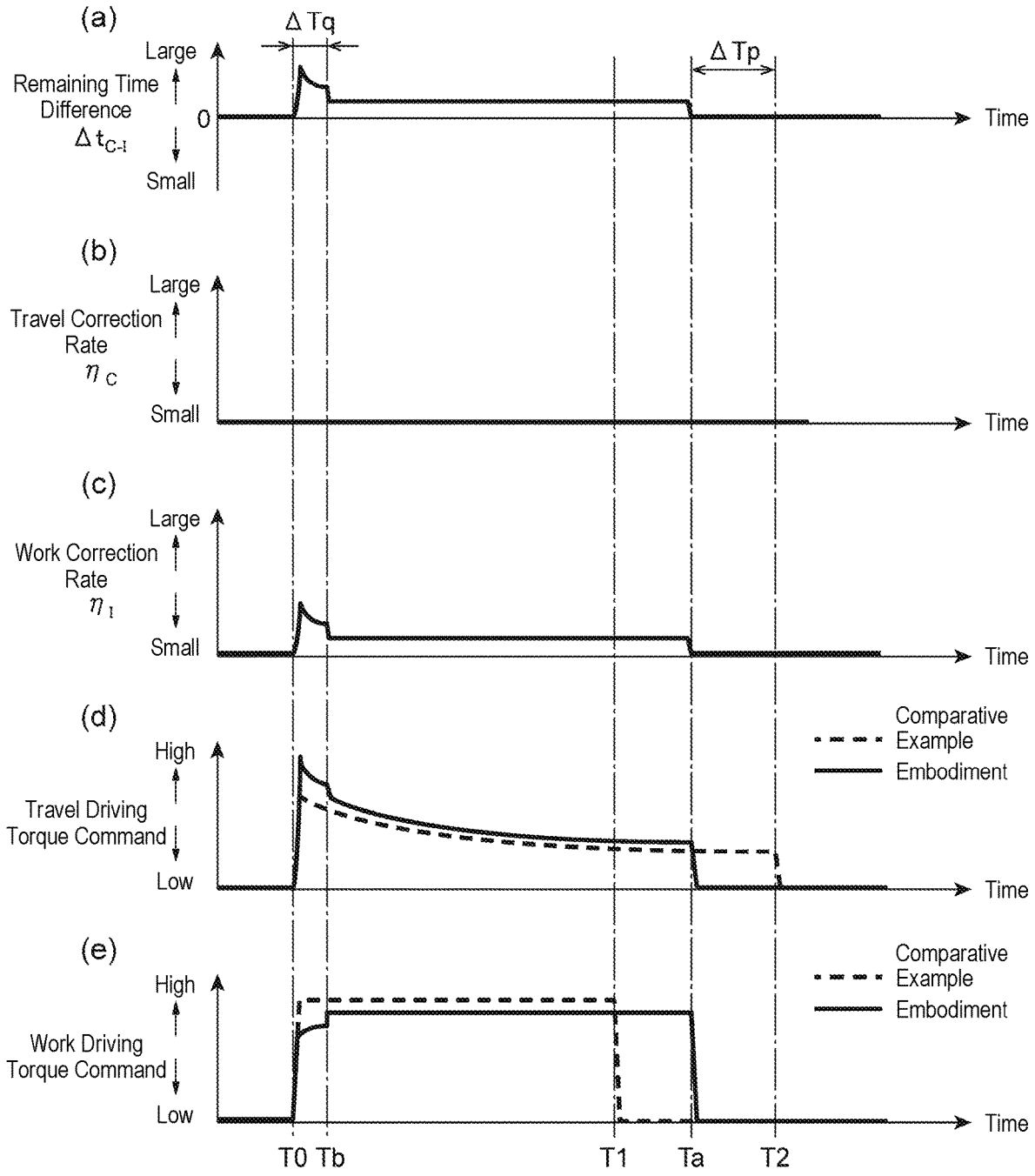
FIG. 11 is a drawing for describing effects (comparisons with Comparative Example) of a work vehicle according to a second embodiment.

The following describes the work vehicle 1 according to the second embodiment with reference to FIG. 11. The work vehicle 1 of the embodiment has a configuration similar to that of the work vehicle 1 of the first embodiment, a process of the main controller 100 differs from that of the first embodiment.

Specifically, as illustrated in FIG. 11, from Time T0 at which the rise/run determination flag is set to ON to Time Tb after a lapse of a predetermined time ΔTq, the travel remaining time calculating unit 111 calculates the travel remaining time $t_C$ and the work remaining time calculating unit 112 calculates the work remaining time $t_1$. The correction rate setting unit 114 sets the work correction rate $\eta_I$ and the travel correction rate $\eta_C$ based on the calculated travel remaining time $t_C$ and work remaining time $t_1$. The set correction rates $\eta_C$ and $\eta_I$ are kept until the rise/run determination flag is switched from ON to OFF. The main controller 100 initializes the correction rates $\eta_C$ and $\eta_I$ to reference values $\eta_{C0}$ and $\eta_{10}$ when the rise/run determination flag is set from ON to OFF.

The predetermined time ΔTq can be appropriately set according to the work content and the performance of the work vehicle 1 and the computational capability and the like of the main controller 100. In order to enhance the calculation accuracy, the predetermined time ΔTq is preferably long, and, for example, securing approximately 0.1 seconds can calculate the travel remaining time $t_C$ and the work remaining time $t_I$ at a certain extent of calculation accuracy. The time between the work vehicle 1 starting the rise/run and stopping the rise/run (Time T0 to Time Ta) is approximately 10 seconds. In view of this, the predetermined time ΔTq is preferred to be a value of 0.1 seconds or more and 10 seconds or less.

The time between the operator operating the arm operating lever 52 of the work vehicle 1 and the arm 2 starting to operate is approximately 0.5 seconds and the time between the operator operating the arm operating lever 52 of the work vehicle 1 and the hydraulic pressure for operating the arm 2 completely increasing is approximately 1.5 seconds. In view of this, the predetermined time ΔTq is further preferred to be set within 0.5 seconds or more and 1.5 seconds or less.

The main controller 100 keeps the correction rates $\eta_C$ and $\eta_I$ set based on the travel remaining time $t_C$ and the work remaining time $t_I$ calculated at Time Tb until the rise/run determination flag is switched from ON to OFF. With this, the correction rates $\eta_C$ and $\eta_I$ do not change even though the operator releases the accelerator pedal 58 or puts the arm operating lever 52 back to the original position during the rise/run operation, or the vehicle speed of the work vehicle 1 is temporarily reduced or the arm angular speed is temporarily reduced during the rise/run operation. Accordingly, for example, when the operator moves the work vehicle 1 forward and rearward for a several times or stops the rise/run in one loading work, the appropriate correction rates $\eta_C$ and $\eta_I$ can be set in advance when the operations at the second time onwards are performed.

With the work vehicle 1 of the embodiment, besides providing the operational advantage similar to that of the first embodiment, the loading work can be performed in many working patterns as described above, and thus, the degree of freedom of the loading work can be improved.

Third Embodiment

Figure 12:
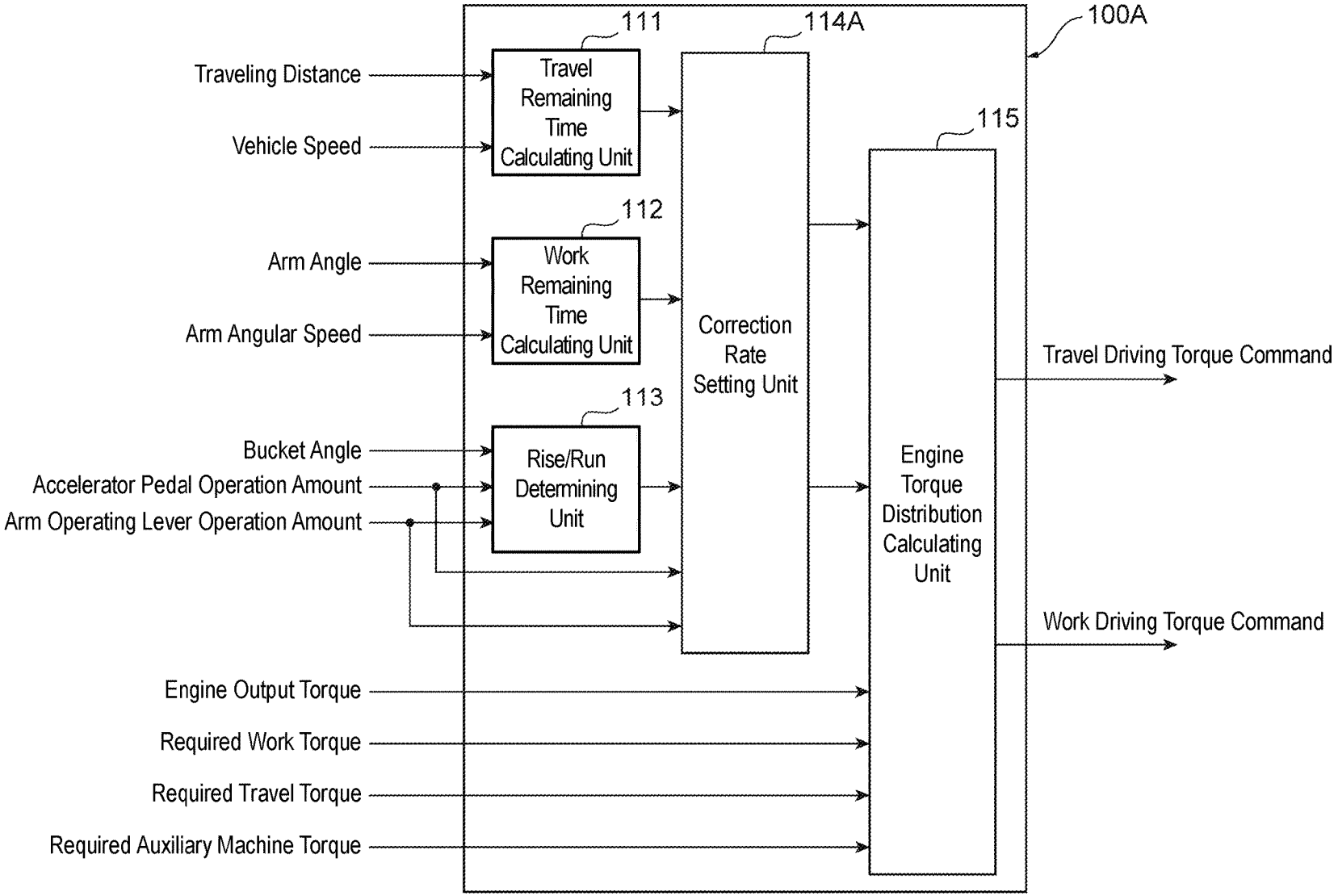
FIG. 12 is a block diagram illustrating a main controller of a work vehicle according to a third embodiment.

The following describes the work vehicle 1 according to a third embodiment with reference to FIG. 12. The work vehicle 1 of the embodiment differs from the first embodiment in the setting method of the travel correction rate and the work correction rate by a correction rate setting unit 114A.

Specifically, as illustrated in FIG. 12, when the rise/run determination flag is set to ON, the correction rate setting unit 114A sets the value obtained by multiplying the correction rate $\eta_C$ set with reference to the correction rate table in FIG. 7 by a ratio $\eta_{acc}$ of the operation amount of the accelerator pedal 58 as a travel correction rate $\eta_C'$ ($\eta_C'=\eta_C\times\eta_{acc}$) when the travel correction rate and the work correction rate are set based on the travel remaining time $t_C$ calculated by the travel remaining time calculating unit 111 and the work remaining time $t_I$ calculated by the work remaining time calculating unit 112, and outputs the set travel correction rate $\eta_C'$ to the engine torque distribution calculating unit 115. Similarly, the correction rate setting unit 114A sets the value obtained by multiplying the correction rate $\eta_I$ set with reference to the correction rate table in FIG. 7 by a ratio $\eta_{arm}$ of the operation amount of the arm operating lever 52 as a work correction rate $\eta_I'$ ($\eta_I'=\eta_I\times\eta_{arm}$), and outputs the set work correction rate $\eta_I'$ to the engine torque distribution calculating unit 115. Note that the ratio $\eta_{acc}$ of the operation amount of the accelerator pedal 58 and the ratio $\eta_{arm}$ of the operation amount of the arm operating lever 52 are set based on, for example, experience points and are preliminarily stored in the ROM 102 of the main controller 100.

Thus, a main controller (the control device) 100A of the embodiment controls the work driving torque such that the work driving torque decreases as the operation amount of the arm operating lever 52 that drives the arm 2 decreases and controls the travel driving torque such that the travel driving torque decreases as the operation amount of the accelerator pedal 58 that drives the wheels 7 decreases. Accordingly, the operation amount of the operating unit that is directly affected by the operator's intention to operate the work vehicle 1 and the correction rate in the rise/run control are proportional, and thus, the operator's intention can be further reflected and a sense of incongruity felt by the operator can be reduced.

Note that various modifications are conceivable for the present invention.

[Modification 1]

For example, the calculation method of the work driving torque command $T_{I_COM}$ and the travel driving torque command $T_{C_COM}$ by the engine torque distribution calculating unit 115 is not limited to that described in the above-described embodiments. The engine torque distribution calculating unit 115 may calculate the work driving torque command $T_{I_COM}$ and the travel driving torque command $T_{C_COM}$ as described below based on the travel correction rate $\eta_C$ and the work correction rate $\eta_I$ set by the correction rate setting unit 114, the engine output torque $T_E$, the required auxiliary machine torque $T_{AUX_REQ}$, the required work torque $T_{I_REQ}$, and the required travel torque $T_{C_REQ}$.

Specifically, the engine torque distribution calculating unit 115 firstly calculates a required torque summed value $T_{SUM_REQ}$ ($T_{SUM_REQ}=T_{I_REQ}+T_{C_REQ}+T_{AUX_REQ}$) summing the required work torque $T_{I_REQ}$, the required travel torque $T_{C_REQ}$, and the required auxiliary machine torque $T_{AUX_REQ}$.

Next, the engine torque distribution calculating unit 115, when the calculated required torque summed value $T_{SUM_REQ}$ is the engine output torque $T_E$ or less, calculates the work target torque $T_{I_TGT}$ and the travel target torque $T_{C_TGT}$ by increasing a predetermined amount from the required work torque $T_{I_REQ}$ and the required travel torque $T_{C_REQ}$ corresponding to the travel correction rate $\eta_C$ and the work correction rate 111 by the amounts of a difference value $\Delta T_E$ between the engine output torque $T_E$ and the required torque summed value $T_{SUM_REQ}$. In this case, the engine torque distribution calculating unit 115 makes the target torque summed value $T_{SUM_TGT}$ summing the required auxiliary machine torque $T_{AUX_REQ}$, the work target torque $T_{I_TGT}$, and the travel target torque $T_{C_TGT}$ equal to the engine output torque $T_E$.

This allows shortening the required time for the rise/run in addition to providing the effect of aligning the time at which the forward traveling is completed and the time at which the arm lifting is completed in the rise/run, thereby allowing a further enhanced improvement effect of the operation efficiency.

[Modification 2]

While the above-described embodiments have described the example using the traveling motor 43 as the travel prime mover supplying power to the traveling device 11, a plurality of the travel prime movers may be used. For example, a configuration using two traveling motors 43 that directly connect to the front wheels 7A on a one-to-one basis, a configuration using four traveling motors 43 that directly connect to four wheels 7 on a one-to-one basis, or a configuration integrating the front wheels 7A and/or the rear wheels 7B with the traveling motor 43 can be employed.

[Modification 3]

While the above-described embodiments have described the example of the hydraulic pressure drive system that transmits the power of the engine 20 to the working device 6 by the drive system that drives the working device 6 converting the hydraulic oil discharged from the hydraulic pressure pump 30A into a mechanical energy with the arm cylinder 4 and the bucket cylinder 5, the present invention is not limited to this. The drive system driving the working device 6 may be an electric drive system. For example, the arm cylinder 4 and the bucket cylinder 5 can be an electric cylinder driven by the electric power generated by the generator motor 40, instead of a hydraulic cylinder.

[Modification 4]

While the above-described embodiments have described the example in which the inverter 41 for generator motor and the inverter 42 for traveling motor are connected via the direct current portion 44, the present invention is not limited to this. The inverter 41 for generator motor and the inverter 42 for traveling motor may be power converters not via direct current portions typified by a matrix converter.

[Modification 5]

While the above-described embodiments have described the example of the work vehicle 1 not including an electric storage device connected to the direct current portion 44, the present invention is not limited to this. The present invention is applicable to a work vehicle that controls voltage of the direct current portion 44 and supplies electric power by connecting the electric storage device including an electric storage element, such as a secondary battery and a capacitor, to the direct current portion 44.

[Modification 6]

The method for determining the start of rise/run and the method for calculating the travel remaining time and the work remaining time are not limited to the methods described in the above-described embodiments. For example, whether the rise/run is started or not may be determined based on image data photographed with a photographing device (the working state detecting device), such as a camera, for monitoring the front of the work vehicle 1 to calculate the travel remaining time and the work remaining time. Whether the rise/run is started or not may be determined based on information detected with an infrared sensor (the traveling state detecting device) that monitors the front of the work vehicle 1 to calculate the travel remaining time and the work remaining time.

[Modification 7]

In the above-described embodiments, the values used for various kinds of determinations and calculations may undergo moving average processing and low-pass filter processing in order to avoid the effects of disturbance and noise. Performing the moving average processing and the low-pass filter processing on the correction rates $\eta_C$ and $\eta_I$ allows suppressing sudden variation in the correction rates $\eta_C$ and $\eta_I$ caused by sudden changes in the vehicle speed or the arm angular speed immediately after the start of rise/run, thereby allowing improved operability.

[Modification 8]

While the above-described embodiments have described the example of the application to the electric-drive type wheel loader, the present invention is also applicable to a hydraulic-drive type wheel loader. For example, the present invention may be applied to a wheel loader that employs a Hydraulic Static Transmission (HST) type power transmission device that is configured of a hydraulic pressure pump for traveling and a hydraulic motor for traveling making a closed circuit connection to one another and converting the power of the engine 20 into a hydraulic pressure and transmitting it to the wheels 7. In this case, the HST hydraulic pressure pump corresponds to the secondary power engine.

[Modification 9]

While the above-described embodiments have described the example in which the correction rate setting unit 114 sets the correction rates $\eta_C$ and (II based on the travel remaining time and the work remaining time, the present invention is not limited to this. The correction rate setting unit 114 may set the correction rates $\eta_C$ and $\eta_I$ based on the vehicle speed and the arm angular speed or the traveling distance and the arm angle. In this case, since the amount of control processing of the main controller 100 can be reduced, the processing speed of the main controller 100 can be improved.

[Modification 10]

The functions of the main controller 100 described in the above-described embodiments may be achieved partly or entirely by hardware (for example, a device in which logic to execute each function is designed in an integrated circuit).

[Modification 11]

Furthermore, while the above-described embodiments have described the example in which the engine torque distribution calculating unit 115 calculates the travel target torque $T_{C_TGT}$ based on the required travel torque $T_{C_REQ}$ and the travel correction rate $\eta_C$ and calculates the work target torque $T_{I_TGT}$ based on the required work torque $T_{I_REQ}$ and the work correction rate $\eta_I$, the present invention is not limited to this. For example, without outputting the travel correction rate $\eta_C$ and the work correction rate $\eta_I$ set by the correction rate setting unit 114 to the engine torque distribution calculating unit 115, the main controller 100 may calculate the value obtained by multiplying the travel correction rate $\eta_C$ by the operation amount of the accelerator pedal 58 as the required travel torque $T_{C_REQ}$ and calculate the value obtained by multiplying the work correction rate 111 by the operation amount of the arm operating lever 52 as the required work torque $T_{I_REQ}$.

While the embodiments of the present invention have been described above, the above-described embodiments are just a part of application examples of the present invention and have no intension of limiting the technical scope of the present invention to the specific configurations of the above-described embodiments. The above-described embodiments and modifications are exemplarily described for easily understanding the present invention, and it is not necessarily limited to including all the described configurations. A part of a configuration of a certain embodiment or modification is allowed to be replaced by a configuration of another embodiment or modification, and a configuration of a certain embodiment or modification is also allowed to be added with a configuration of another embodiment or modification. Note that the control lines and the information lines illustrated in the drawings are those considered necessary for description and do not necessarily illustrate all the control lines and the information lines necessary for the product. In practice, almost all the configurations may be considered mutually connected.

REFERENCE SIGNS LIST

1 Work vehicle
2 Arm
3 Bucket
4 Arm cylinder
5 Bucket cylinder
6 Working device
7 Wheel
8 Vehicle body
11 Traveling device
15 Steering cylinder
17 Brake cylinder
18 Parking brake cylinder
20 Engine
30A Hydraulic pressure pump (work prime mover)
30B, 30C Hydraulic pressure pump
40 Generator motor (travel prime mover)
41 Inverter for generator motor
42 Inverter for traveling motor
43 Traveling motor (travel prime mover)
51 Forward and rearward movement switch
52 Arm operating lever
53 Bucket operating lever
54 Mode changeover switch (mode changeover device)
58 Accelerator pedal
61 Vehicle speed sensor (traveling state detecting device)
62 Arm relative angle sensor (working state detecting device)
63 Bucket relative angle sensor (working state detecting device)
100, 100A Main controller (control device)
111 Travel remaining time calculating unit
112 Work remaining time calculating unit
113 Rise/run determining unit
114, 114A Correction rate setting unit
115 Engine torque distribution calculating unit

The invention claimed is:

1. A wheel loader comprising:

a traveling device that causes a vehicle body to travel;

a travel prime mover that supplies a travel driving force to the traveling device;

a working device disposed on the vehicle body, the working device including an arm turnably in a vertical direction and a bucket coupled to a distal end portion of the arm and mounted turnably in the vertical direction;

an arm operating level for operating the arm;

an accelerator pedal for accelerating the vehicle body;

a work prime mover that supplies a work driving force to the working device;

a traveling state detecting device that detects a traveling state of the vehicle body including a vehicle speed and a traveling distance;

a working state detecting device that detects a working state of the working device including an angle of the arm; and a control device that controls the travel prime mover and the work prime mover, wherein the control device:

determines whether a specific condition that identifies lifting of the arm during forward traveling of the vehicle body during a loading work is satisfied or not, based on the traveling state of the vehicle body detected by the traveling state detecting device and the working state of the working device detected by the working state detecting device;

sets a travel correction rate for adjusting the travel driving force and a work correction rate for adjusting the work driving force, based on the vehicle speed and the traveling distance detected by the traveling state detecting device, the angle of the arm detected by the working state detecting device, and a target traveling distance set in advance, and a target arm angle set in advance, when the specific condition is determined to be satisfied;

controls the travel driving force of the travel prime mover and the work driving force of the work prime mover based on the set travel correction rate and work correction rate so that a time at which the angle of the arm reaches the target arm angle converges with a time at which the vehicle body reaches the target traveling distance;

calculates a remaining time until the target traveling distance is reached as a travel remaining time based on the vehicle speed and the traveling distance, and the target traveling distance;

calculates a remaining time until the target arm angle is reached as a work remaining time based on the angle of the arm and the target arm angle;

sets the travel correction rate and the work correction rate based on the calculated travel remaining time and work remaining time; and controls a torque of the travel prime mover and a torque of the work prime mover based on the set travel correction rate and work correction rate, the specific condition is a condition under which it is determined that rise/run of the wheel loader is started based on an angle of the bucket being equal to or more than a predetermined angle threshold value and operation amounts of the accelerator pedal and the arm operating lever are increased, the travel remaining time is calculated by a formula:

$$t_c = \frac{d_{RR} - d_1}{v_1},$$

wherein $t_c$, $d_{RR}$, $d_1$, and $v_1$ respectively represent the travel remaining time, a target rise/run distance, the traveling distance at a time $t_1$ after a lapse of a predetermined time from a rise/run starting time to, and the vehicle speed of the wheel loader at the time $t_1$, and the work remaining time is calculated by a formula:

$$t_1 = \frac{\theta_{RR} - \theta_1}{v_{\theta 1}},$$

wherein $t_1$, $\theta_{RR}$, $\theta_1$, and $V_{\theta 1}$ respectively represent the work remaining time, the target arm angle, the angle of the arm at the time $t_1$ after the lapse of the predetermined time from the rise/run starting time to, and an arm angular speed of the wheel loader at the time $t_1$.

2. The wheel loader according to claim 1, wherein the control device:

sets the work correction rate such that the shorter the work remaining time is than the travel remaining time, the larger the work correction rate is set so as to restrict a lifting speed of the arm; and sets the travel correction rate such that the longer the work remaining time is than the travel remaining time, the larger the travel correction rate is set so as to restrict the vehicle speed.

3. The wheel loader according to claim 1, wherein the travel prime mover is a traveling motor.

4. The wheel loader according to claim 1, further comprising a mode changeover device that switches between an execution mode that executes setting of the travel correction rate and the work correction rate and an inhibition mode that inhibits the execution of the setting of the travel correction rate and the work correction rate.

* * * * *